350-333
E197Y XR $$$ SR
4,070,663
IX 350/333

United State
Kanatani et al.

[1] 4,070,663
[5] Jan. 24, 1978

[54] CONTROL SYSTEM FOR DRIVING A CAPACITIVE DISPLAY UNIT SUCH AS AN EL DISPLAY PANEL

[75] Inventors: Yoshiharu Kanatani; Masahiro Ise; Etsuo Mizukami; Kenzoh Inazaki, all of Tenri; Chuji Suzuki, Nara, all of Japan

[73] Assignee: Sharp Kabushiki Kaisha, Osaka, Japan

[21] Appl. No.: 703,127

[22] Filed: July 7, 1976

[30] Foreign Application Priority Data

| | | |
|---|---|---|
| July 7, 1975 | Japan | 50-83767 |
| July 18, 1975 | Japan | 50-88510 |
| July 23, 1975 | Japan | 50-90650 |
| Aug. 8, 1975 | Japan | 50-96967 |
| Aug. 8, 1975 | Japan | 50-96968 |
| Aug. 11, 1975 | Japan | 50-97783 |

[51] Int. Cl.[2] ..... G06F 3/14
[52] U.S. Cl. ..... 340/324 M; 340/166 EL; 350/160 LC

[58] Field of Search ..... 340/324 R, 324 M, 166 EL, 340/343; 350/160 R, 160 LC; 315/169 R, 169 TV

[56] References Cited

U.S. PATENT DOCUMENTS

| | | | |
|---|---|---|---|
| 3,692,388 | 9/1972 | Hall, Jr. et al. | 340/324 EC |
| 3,736,043 | 5/1973 | Sambucetti | 340/324 EC |
| 3,991,416 | 11/1976 | Byles et al. | 34/324 R |

*Primary Examiner*—Marshall M. Curtis
*Attorney, Agent, or Firm*—Birch, Stewart, Kolasch & Birch

[57] ABSTRACT

A coil is serially connected to a capacitive display unit, such as an EL display panel, which includes an insulating display element sandwiched between a pair of electrodes. The coil and the electrostatic capacitance of the display unit function, in combination, to form an LC resonance circuit, which limits transient current flowing through the insulating display element and enables the display unit to operate in a low power dissipation mode. An alternating driving signal to be applied to the display unit has an intermediate potential period on which a writing pulse is superimposed, thereby to minimize high voltage requirement of the writing circuit.

11 Claims, 35 Drawing Figures

CONTROL SYSTEM FOR DRIVING A CAPACITIVE DISPLAY UNIT SUCH AS AN EL DISPLAY PANEL

BACKGROUND OF THE INVENTION

The present invention relates to a control circuit for driving a capacitive display unit such as an EL display panel.

Recently, a new fact has been discovered that a certain type of the light-emitting elements such as ZnS thin-film light-emitting elements exhibits hysteresis behavior in its light emitting mechanism. Thus, utilization of such hysteresis behavior makes it possible to provide the light-emitting elements with memory capacity so that a matrix of such light-emitting body may provide character display functions in a two-dimensional manner.

A typical drive system for the above-mentioned matrix panel is disclosed in, for example, U.S. Pat. No. 3,946,371 to Kenzoo Inazaki, Yoshiharu Kanatani, Masahiro Ise, Etsuo Mizukami and Chuji Suzuki, entitled "DRIVE SYSTEM FOR MEMORY MATRIX PANEL", issued on Mar. 23, 1976.

In such a drive system, an alternating sustaining pulse is required to be applied to the whole area of the display panel in order to maintain the light-emitting condition of the written position or the erased position. As is well known, the thin-film EL element is a capacitive display element, and the total capacitance of the display panel is considerably high when a large display panel is fabricated. When such a large display panel is driven through the use of conventional CR charging and discharging switching technique, a large transient current flows through the display element. This will damage the switching elements and electrodes formed on the thin-film EL display panel. It is required to limit the transient current without increasing the power dissipation. Such problems occur not only in the EL display panel but also in usual capacitive display units, such as a plasma display unit and a liquid crystal display unit, which have an insulating display layer sandwiched between a pair of electrodes.

OBJECTS AND SUMMARY OF THE INVENTION

Accordingly, an object of the present invention is to provide a driving circuit for driving a capacitive display panel in a low power dissipation mode.

Another object of the present invention is to provide a driving circuit for enabling an EL display panel having hysteresis characteristics to emit light in high brightness.

Still another object of the present invention is to provide a switching circuitry for applying an alternating driving voltage signal to an EL display panel through the use of a DC power source.

Yet another object of the present invention is to provide a driving system for driving an EL display panel, wherein high voltage requirement of a circuit for developing a writing pulse is minimized.

A further object of the present invention is to provide a driving system for a memory matrix EL panel which ensures accurate writing operation.

A still further object of the present invention is to stabilize the sustaining operation in an EL display panel having hysteresis characteristics.

A yet further object of the present invention is to minimize a required number of input wires of a writing switch circuitry in a driving circuit for an EL display panel.

Another object of the present invention is to provide a driving method for an EL display panel, wherein writing operation is performed in considerably high speed.

Still another object of the present invention is to provide a line erasing circuit for applying an erasing voltage signal to a desired line in a memory matrix EL panel.

Yet another object of the present invention is to provide a read out circuit for reading out the condition of any point in a memory matrix EL panel.

A further object of the present invention is to provide a capacitive display panel and a drive system thereof suited for an input and output terminal of a computer.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a coil is serially connected to a capacitive display panel such as a memory matrix EL display panel. The coil and the electrostatic capacitance of the display panel function, in combination, to form an LC resonance circuit, which limits transient current flowing through the capacitive display panel and enables the display panel to operate in a low power dissipation mode. A rectifying means is interposed between the display panel and the coil, thereby to maintain the potential of the capacitive elements at a desired value.

A driving circuit for activating the display panel is adapted to develop an alternating driving signal having an intermediate potential period on which a writing pulse is superimposed, thereby to minimize high voltage requirement of a writing circuit and to permit rapid writing operation.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
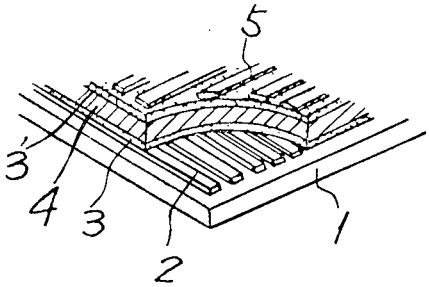
FIG. 1 is a perspective view showing a typical construction of a memory matrix EL panel.

Referring now in detail to the drawings, and to facilitate a more complete understanding of the present invention, a typical construction and a characteristic of a memory matrix EL panel for use in the present invention will be first described with reference to FIGS. 1 and 2.

A plurality of transparent line electrodes 2 are formed on a glass substrate 1. A dielectric film 3 made of, for example, $Y_2O_3$ or $N_2Si$ is formed on the transparent line electrodes 2 and the glass substrate 1, and upon which an electro luminescent layer 4 made of a ZnS thin film doped with manganese is formed. Another dielectric film 3' is formed on the electro luminescent layer 4 to the thickness of 50–5000A through the use of evaporation technique or a spattering method. A plurality of transparent line electrodes 5 are formed on the dielectric film 3' in such a manner that the electrodes 2 and 5 cross with each other at a right angle. With such an arrangement, a matrix drive can be achieved by applying selection signals to the electrodes 2 and 5.

Figure 2:
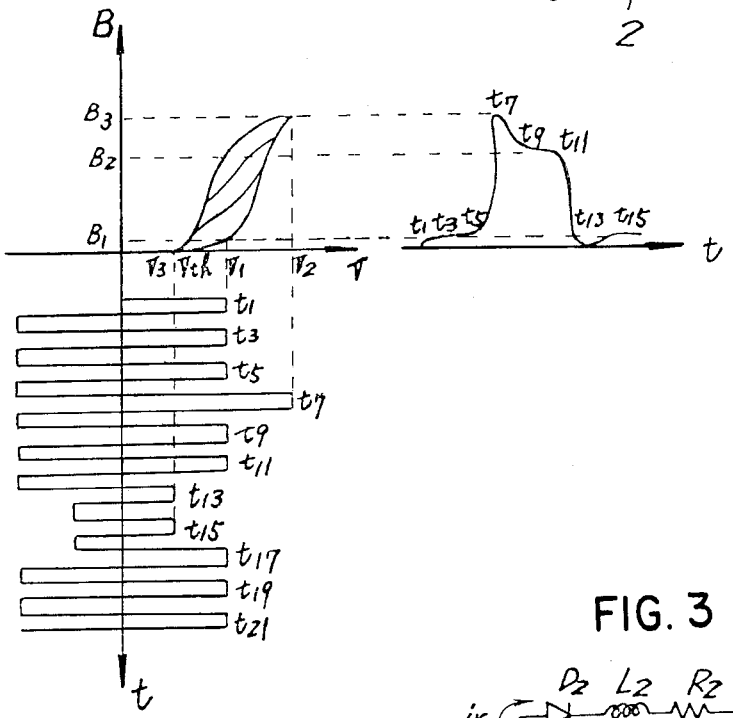
FIG. 2 is a graph showing brightness of electroluminescent versus applied voltage characteristics of an EL element for use in the present invention.

Respective picture points in the matrix EL panel exhibit a hysteresis behavior in the brightness versus applied voltage curve as shown in FIG. 2. At first, when a pulse of a voltage amplitude of $V_1$ is applied to the element, the element emits light at brightness $B_1$. Such a sustaining voltage $V_1$ must be greater than or equal to a light-emission threshold voltage Vth. When a write-in voltage $V_2$ is applied to the element, the brightness is increased to a level $B_3$ and, thereafter, the brightness is maintained at a level $B_2$, which is greater than the level $B_1$, by application of the following sustaining voltage $V_1$. That is, the write-in operation is performed.

Under these conditions, when an erasing voltage $V_3$ is applied to the element, the brightness is suddenly reduced and, thereafter, the brightness is maintained at the level $B_1$ by the following sustaining voltage $V_1$. The hysteresis curve configuration can be desirably changed by changing the voltage amplitude or the pulse width of the write-in voltage. That is, a display of intermediate tone can be achieved. It will be clear from the foregoing description that the above EL display panel has a memory function. Preferred voltage levels of the respective signals are as follows:

Vth = 200V;
$V_1$ = 210V;
$V_2$ = 230–280V; and
$V_3$ = 190V

Figure 3:
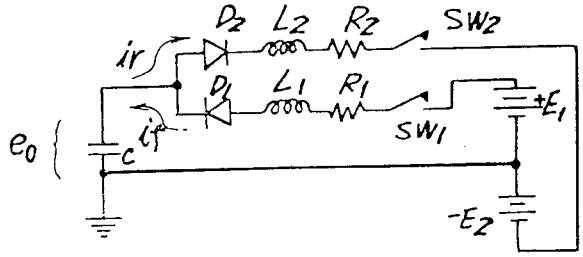
FIG. 3 is a schematic circuit diagram showing a principal construction of a driving circuit of the present invention.

FIG. 3 shows a principal construction of a drive circuit of the present invention.

The EL display panel is one of a capacitive display panel and, therefore, the capacitive component of the EL display panel is designated by C. A series circuit consisting of a diode $D_1$, a coil $L_1$, a resistor $R_1$ and a switching element $SW_1$ is interposed between the capacitive component C and a positive DC power source $E_1$. And another series circuit including a diode $D_2$, a coil $L_2$, a resistor $R_2$ and a switching element $SW_2$ is connected between the capacitive component C and a negative DC power source $E_2$. The diodes $D_1$ and $D_2$ are connected in forward directions with respect to the power source $E_1$ and $E_2$, respectively. The resistors $R_1$ and $R_2$ include resistance values of the electrodes formed within the EL display panel and equivalent resistance of the circuitry.

Operation of the circuit of FIG. 3 will be described with reference to FIGS. 4(a) and 4(b).

Figure 4A:
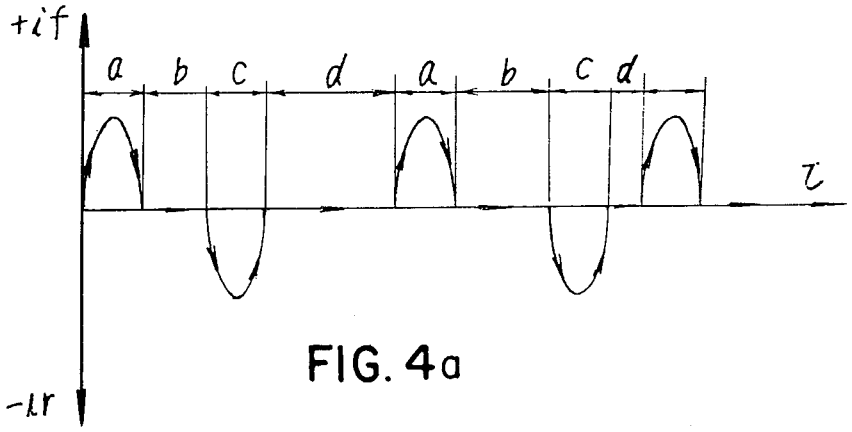
FIG. 4(a) is a graph showing a current waveform in the circuit of FIG. 3.

When the switching element $SW_1$ is on and the switching element $SW_2$ is off, a period *a* in FIG. 4(a), a charging current if flows from the positive power source $+E_1$. The voltage level of the capacitive component C is $V_1$, which is greater than the power source voltage $E_1$, when a half cycle period of the LC resonance frequency has passed as shown in FIG. 4(b). At this moment, the diode $D_1$ is biased backward and, therefore, the voltage $V_1$ is held. During this holding period *b*, the switching element $SW_1$ is either on or off, and the switching element $SW_2$ is kept off.

During the following period *c*, the switching element $SW_1$ is off, and the switching element $SW_2$ is on and, therefore, a current ir flows from the negative power source $-E_2$ as shown in FIG. 4(a). When the half cycle period has passed, the diode $D_2$ is off and, hence, the voltage $-V_2$ is held. During the following holding period *d*, the switching element $SW_1$ is kept off, and the switching element $SW_2$ is either on or off.

The above-mentioned operation is repeated, thereby to apply sustaining pulses to the EL display panel. The resonance frequency of the LC resonance circuit functions to limit the current flowing to the capacitive component C, and the diode functions to hold the voltage level. The current limiting condition can be changed by selectively varying the inductance of the coils $L_1$ and $L_2$, and the frequency of the sustaining pulses can be changed by varying the switching frequency of the switching elements $SW_1$ and $SW_2$. The EL display panel emits light at high brightness because the voltage levels $V_1$ and $V_2$ are held and, hence, the EL element receives the voltage $|V_1 + V_2|$, which is greater than the power source voltage $|E_1 + E_2|$, at the switching operation.

Moreover, the power dissipation is minimized in the above-mentioned circuit, the reason of which is as follows:

Now assume the condition where the current if is flowing from the positive DC power source $+E_1$ to the capacitive component C.

When the diode $D_1$ is omitted from the circuit of FIG. 3, the circuit is a conventional LCR series resonance circuit. When the switch $SW_1$ is closed, the current if expressed below flows from the DC power source $E_1$, and a voltage $+e_0$ expressed below appears across the capacitor C.

$$if = \frac{E_1}{fL} e^{-\alpha\tau} \sin f\tau \tag{1}$$

$$e_o = \frac{1}{C} \int_0^{\tau} id\tau$$

$$= \frac{E_1}{LC} \frac{1}{\alpha^2+f^2} \left\{ 1 - e^{-\alpha\tau} \left(\frac{\alpha}{f} \sin f\tau + \cos f\tau\right) \right\}$$

$$= E_1 \{ 1 - e^{-\alpha\tau} \left(\frac{\alpha}{f} \sin f\tau + \cos f\tau\right) \tag{2}$$

where:

$E_1$ is a voltage level of the power source $E_1$;

L is an inductance value of the coil L;

C is a capacitance value of the capacitive component C;

$$= \frac{R}{2L} \left( \text{the attenuation constant under the oscillation condition } \frac{1}{LC} > \frac{R^2}{4L^2} \right); \text{ and}$$

$$f = \sqrt{\frac{1}{LC} - \frac{R^2}{4L^2}} \left( \text{the natural oscillation frequency under the oscillation condition } \frac{1}{LC} > \frac{R^2}{4L^2} \right)$$

Figure 5A:
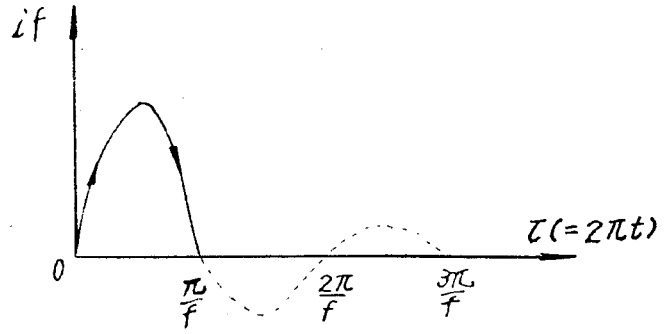
FIG. 5(a) is a graph showing a current waveform for use in explanation of operation of the circuit of FIG. 3.
Figure 5B:
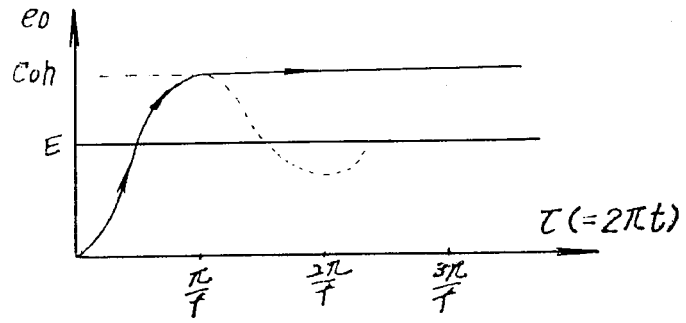
FIG. 5(b) is a graph showing a voltage waveform for use in explanation of operation of the circuit of FIG. 3.

FIGS. 5(a) and 5(b) show the variation modes of the current if and the voltage $e_0$. In the case of a series resonance circuit wherein the diode $D_1$ is omitted, the attenuating oscillation is performed as shown in broken lines in FIGS. 5(a) and 5(b). When the diode $D_1$ is connected to the circuit in a series fashion, the resonance is performed during the first half period following the throwing of the switch $SW_1$ since the diode $D_1$ is biased forward. But the voltage potential across the capacitor C is held after the half cycle period ($\tau = \pi/f$) has passed because the diode $D_1$ is biased backward. This condition is shown by solid line in FIG. 5(b). The holding voltage $e_{oh}$ can be expressed as follows:

$$e_{oh} = E_1 (1 + e^{-\alpha\pi/f}) \tag{3}$$

$\alpha$ approximates zero in an ideal condition where the R approximates zero, the forward resistance of the diode is negligible and the power dissipation at the capacitive component C and the coil L is also negligible. Therefore, $e_{oh} \doteqdot 2E_1$ is derived from the equation (3). That is, the voltage is held at an amplitude twice the power voltage $E_1$.

The energy dissipation during the first half period following the throwing of the switch $SW_1$ under the ideal resonance can be expressed as follows:

$$\int_0^{\frac{\pi}{f}} if \cdot e_0 \, d\tau = \frac{E_1^2}{fL} \int_0^{\frac{\pi}{f}} \sin f\tau \, (1 - \cos f\tau) \, d\tau = \frac{2E_1^2}{f^2 L} \tag{4}$$

The equation (4) can be expressed as follows since $$f = \sqrt{\frac{1}{LC}}.$$

$$\frac{2E_1^2}{f^2 L} = 2CE_1^2 = \tfrac{1}{2}C(2E_1)^2 \tag{5}$$

That is, the energy required during this half period is that required to charge the capacitive component C to the level $2E_1$.

Although the thin-film EL element is a capacitive element, it is not a capacitor of no loss. The loss is considerably low when the element is driven by low voltage signals which can not provide light emission. But the emission loss occurs in a nonlinear fashion when the element is driven by the voltage of a high amplitude. Moreover, the power dissipation occurs at the electrodes, switching elements and the coil and, therefore, the power must be supplied from the power source to perform the resonance. In order to facilitate an understanding, the non-linear factor such as the emission loss is omitted from the following consideration. In FIG. 3, constant resistors $R_1$ and $R_2$ are incorporated in the circuit to form an LCR series resonance circuit, the resistors $R_1$ and $R_2$ including the electrode resistance, the on resistance of the switching elements and the resistance value of the coil. The necessary power voltage to drive the circuit in the normal condition of +V to −V drive is as follows:

$$E = \frac{1 - e^{-\alpha \frac{\pi}{f}}}{1 + e^{-\alpha \frac{\pi}{f}}} \times V \quad (6)$$

The equation (6) shows that E ÷ 0 in the ideal resonance R ÷ 0. That is, the capacitor C (thin-film EL element) can be driven without power supply of $E_1(-E_2)$ in the voltage drive of $+V_1$ to $-V_2$ when the capacitor C is first charged to the voltage level V. Whereas, E = V when the resistors $R_1$ and $R_2$ satisfy the condition $$R = 2\sqrt{\frac{L}{C}} .$$

This is due to the critical damping condition. In the actual circuit, O <E<V<2E. That is the loss becomes small as $$\eta = \frac{V - E}{E} = e^{-\alpha \frac{\pi}{f}}$$

becomes large.

Figure 6:
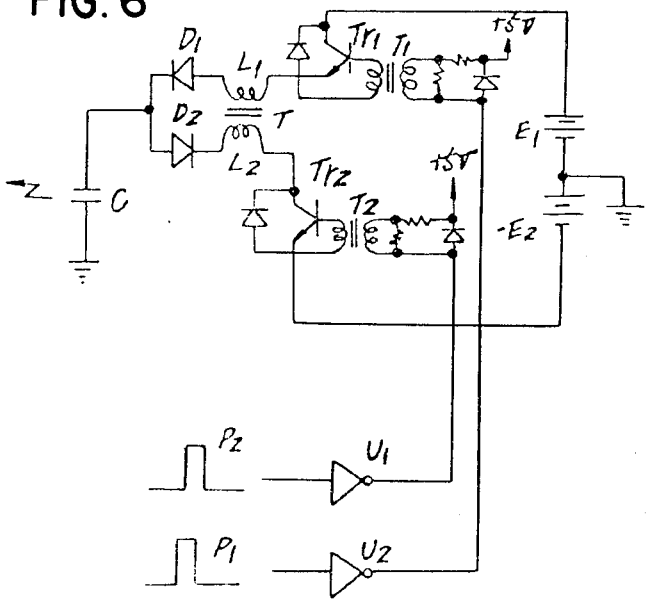
FIG. 6 is a detailed circuit diagram of an embodiment of a drive circuit of the present invention.

FIG. 6 shows a detailed circuit construction of the driving circuit of the present invention.

In FIG. 6, C is a capacitive component of the thin-film EL element, $D_1$ and $D_2$ are holding diodes, T is a transformer for the resonance coils $L_1$ and $L_2$, $Tr_1$ and $Tr_2$ are switching transistors, $T_1$ and $T_2$ are coupling transformer, $U_1$ and $U_2$ are TTL inverters of the opened collector type, and $P_1$ and $P_2$ represent switching pulses. The winding ratio of the primary winding and the secondary winding of the transformer T is 1 : 1. The pulse width of the pulses $P_1$ and $P_2$ is greater than the half period of the natural oscillation but smaller than the natural oscillation period.

Figure 4B:
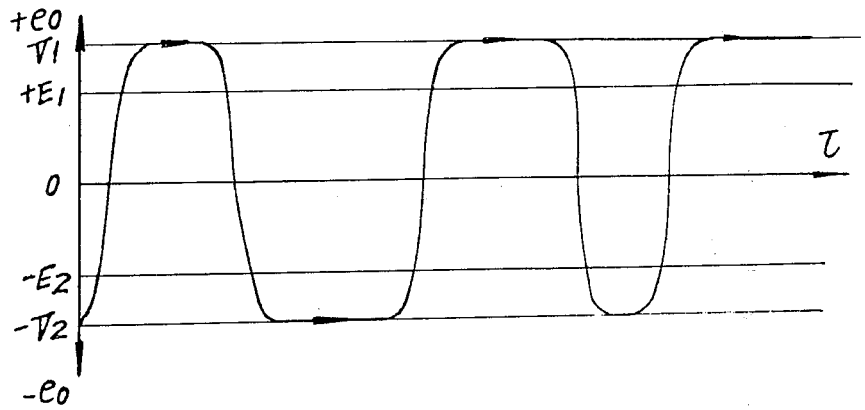
FIG. 4(b) is a graph showing a voltage waveform in the circuit of FIG. 3.

When the timing pulses $P_1$ and $P_2$ are applied to the circuit at the periods *a* and *c* shown in FIG. 4(a), respectively, the transistors $Tr_1$ and $Tr_2$ are controlled to switch between on and off in synchronization with said pulses and, therefore, the voltage shown in FIG. 4(b) is applied to the thin-film EL element. This voltage is applied to whole picture points in the EL matrix panel as a sustaining pulse. In this embodiment, the driving voltage amplitude can be selected within a range of zero to $E(1 + e^{-\alpha\pi/f})$ by varying the pulse width of the pulses $P_1$ and $P_2$, which control the on period of the switching elements $Tr_1$ and $Tr_2$, in a range within the half cycle period.

Figure 7:
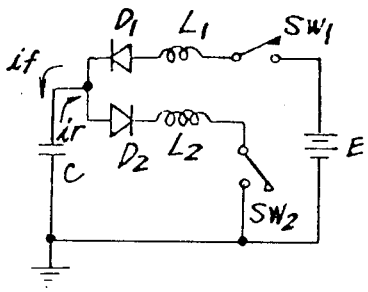
FIG. 7 is a schematic circuit diagram showing a principal construction of another embodiment of a drive circuit of the present invention.

FIG. 7 shows a principal construction of another embodiment of the present invention. In this embodiment, the capacitive component C is charged by a power source E through the switch $SW_1$, the coil $L_1$ and the diode $D_1$, and the capacitive component C is discharged through the diode $D_2$, the coil $L_2$ and the switch $SW_2$. In this embodiment, only one DC power source is required to perform the alternating voltage drive.

Figure 8:
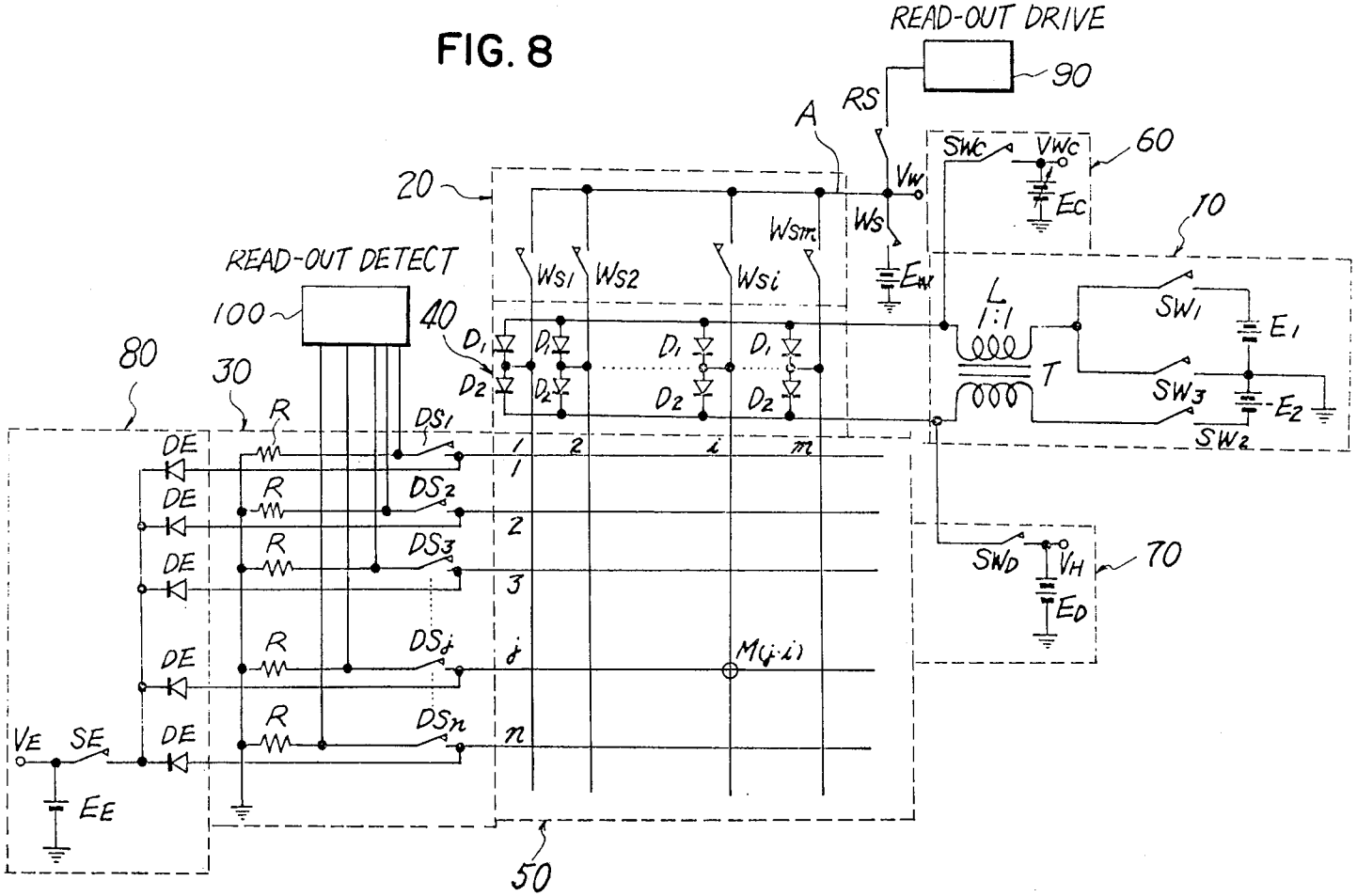
FIG. 8 is a detailed circuit diagram of still another embodiment of a drive circuit of the present invention.

FIG. 8 shows still another embodiment of the present invention, wherein a multiple phase resonance sustaining drive circuit is employed to minimize high voltage requirement of a writing circuit.

A sustaining drive circuit 10 is a three phase resonance sustaining drive circuit. A switching circuit 20 controls write-in operation and read-out operation. The switching circuit 20 functions to apply a write-in voltage $V_w$ to a desired X-line in a write-in phase, and to apply a read-out voltage $V_r$ to a desired X-line in a read-out phase. A data switch circuit 30 comprises switches $DS_1$ through $DS_n$ and detection resistors R. All the switches $DS_1$ through $DS_n$ are grounded or short-circuited during a sustaining drive period, and a desired Y-line is kept in the short-circuited condition and the others or non selected Y-lines are opened during a write-in phase. A circuitry 40 controls a line separation in writing and reading operation and functions to hold the sustaining amplitude in the resonance drive. 50 designates a memory matrix EL panel to be driven. The system further includes a compensation circuit 60 for a half selected level in writing operation, a sustaining potential stabilizing circuit 70, and a line erasing circuit 80.

The operation of the above system will be described hereinbelow.

1. SUSTAINING DRIVE

Figure 9:
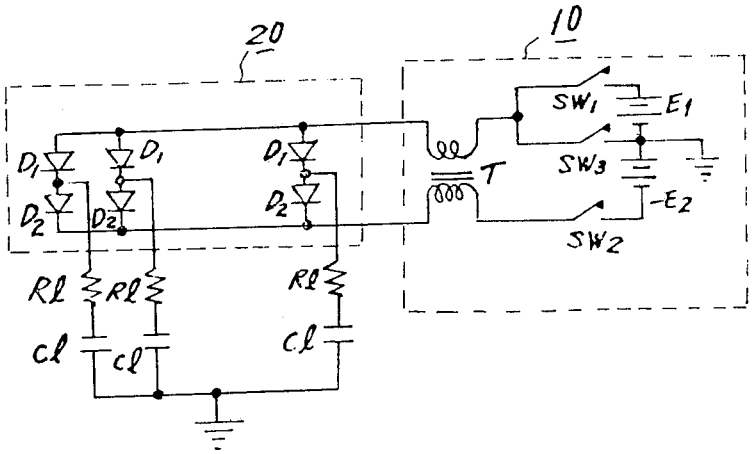
FIGS. 9 and 10 are simplified circuit diagrams of the circuit of FIG. 8.

In the sustaining drive period, all the switches in the data switch circuit 30 are closed and, therefore, the circuit of FIG. 8 can be simplified as shown in FIG. 9. In FIG. 9, $R_l$ is an estimated resistance value of one line and cl is an estimated capacitance value of one line.

Figure 10:
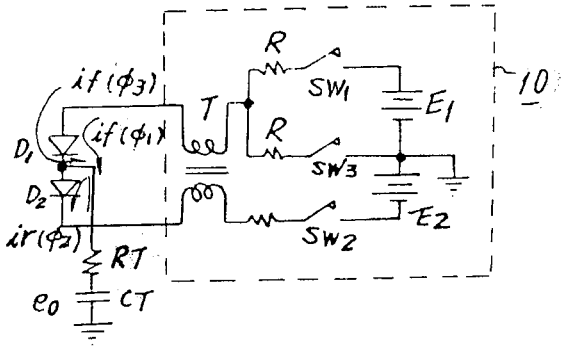

The circuit of FIG. 9 can be more simplified as shown in FIG. 10. RT includes the on resistance of the switching element, the forward resistance of the diode, the loss in the transformer and the emission loss in the EL panel. Although these factors vary in a non-linear fashion as the voltage and current vary, they are estimated as a constant resistance loss for the purpose of simplicity. In FIG. 10, $$R_T = Rl/m,\ C_T = mC_l$$

where: *m* is the number of X-line.

Figure 11:
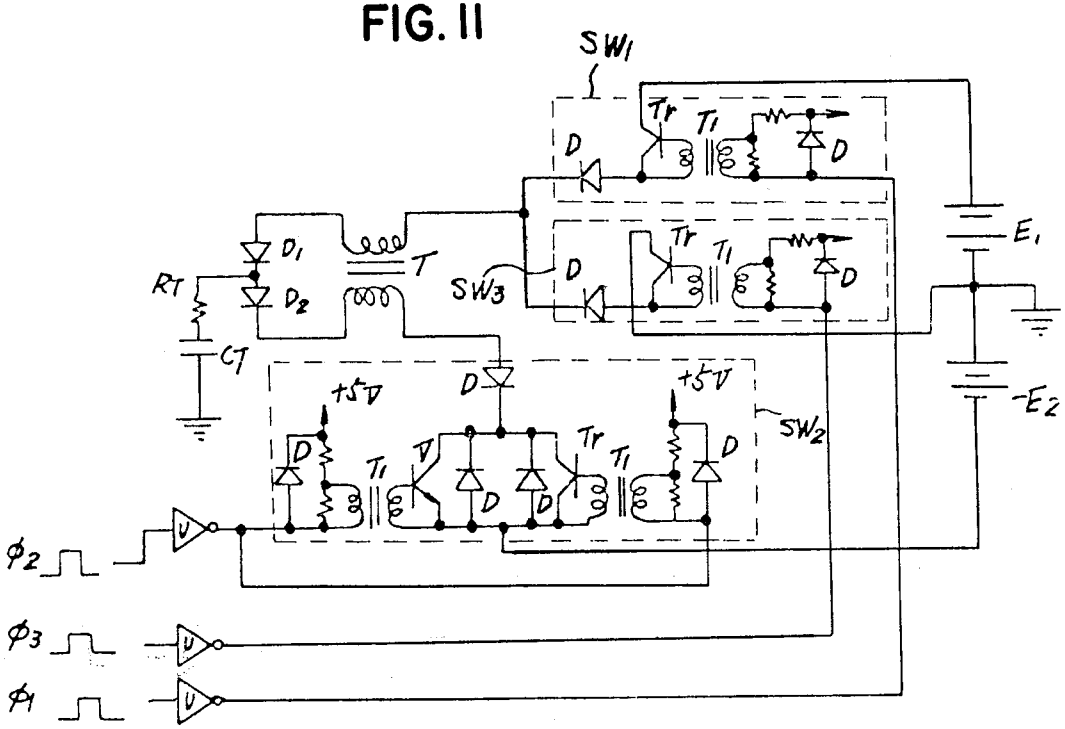
FIG. 11 is a detailed circuit diagram showing a part of the circuit of FIG. 8.
Figure 12A:
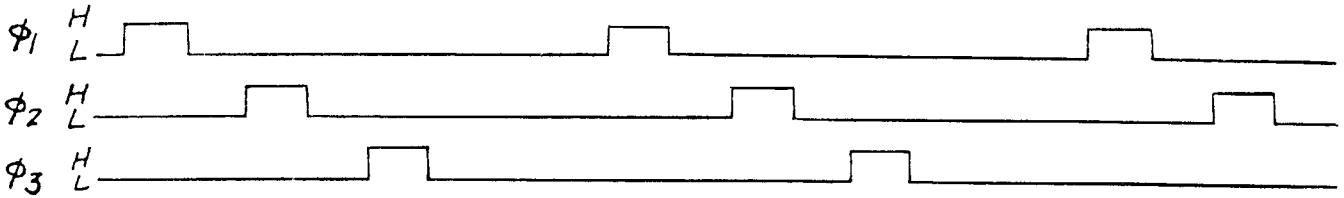
FIG. 12(a), 12(b) and 12(c) are time charts showing operation of the circuit of FIG. 8.
Figure 12B:
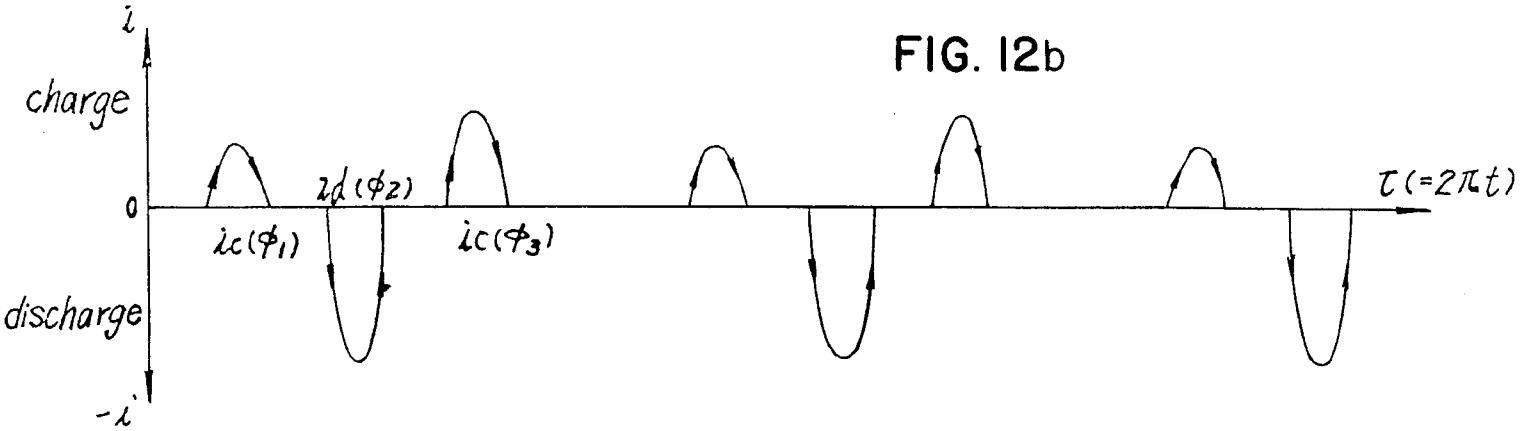
Figure 12C:
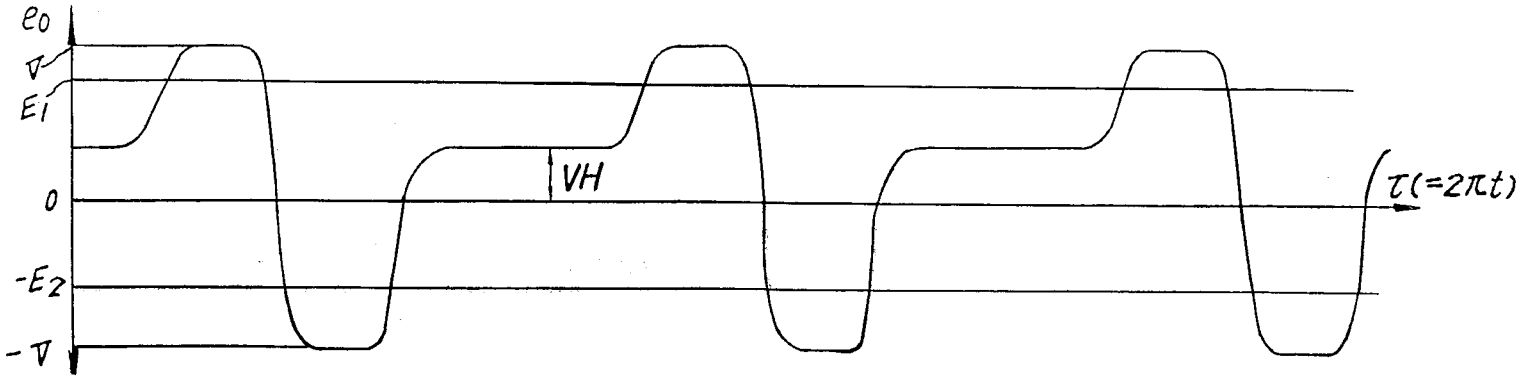

FIG. 11 is a detailed circuit diagram of FIG. 10. FIG. 12(a) illustrates switching pulses, FIG. 12(b) illustrates a charge and discharge current waveform, and FIG. 12(c) illustrates a driving voltage waveform to be applied to the X-line.

The inventors have made tests on an eight inches EL display panel, the specification of which is as follows:

line pitch: two lines/mm
- X-line (transparent electrode) — 320 lines
- Y-line (rear aluminium electrode) 240 lines display character: 64 kinds of Roman letter, Arabic numerals,
- and symbols in a 5 × 7 dot matrix structure number of characters displayed:
- X-direction (scan direction) — 52 characters
- Y-direction (data side) — 24 rows
- maximum number of characters displayed — 1248 characters effective number of lines displayed:
- X-direction — 260 lines (one line space)
- Y-direction — 168 lines (two line space)

In FIG. 11:
- U : TTL of the opened collector type
- Tr : switching transistor
- $T_1$ : coupling transformer
- D : protective diode
- $D_1$, $D_2$ : holding diodes
- T : resonance transformer Like elements corresponding to those of FIG. 8 are indicated by like numerals.

In the circuit of FIG. 11, the circuit constant is selected as follows:

Inductance of the resonance transformer — L = 29 mH

The panel capacitance when the effective number of lines for display are connected — $C_T = 0.377\ \mu F$ The clock pulses $\phi_1$, $\phi_2$ and $\phi_3$ are shaped as follows:

pulse width — 200 μsec.

repetition of respective pulses — 330 Hz

The resonance drive is performed under the foregoing condition.

| | | |
|---|---|---|
| Hold voltage | $+V_1$ | = 215 volts |
| | $-V_2$ | = −230 volts |
| | $V_H$ | ÷ 70 volts |
| Power voltage | $+E_1$ | = 180 volts |
| | $-E_2$ | = −135 volts |
| Natural oscillation : | | 4 - 5 KHz |

By taking the foregoing results into consideration, the constant resistance RT, which includes a transparent electrode resistance of the thin-film EL panel, the on-resistance of the switching transistor, the non-linear loss of the thin-film EL panel in the large amplitude drive, the forward resistance of the diode and the loss in the coil, can be calculated as follows:

$$RT = 115\Omega - 125\ \Omega$$

The attenuation constant can be calculated as follows:

$$\alpha \approx 2 \times 10^3$$

$$\eta = \exp(-\alpha\pi/f) \approx 0.30 - 0.32$$

The EL panel has a three layer construction as shown in FIG. 1, that is the ZnS (Mn) layer is sandwiched between the insulating layers. The sustaining emission can be stabilized when the driving voltage has asymmetric configuration even though the construction of the EL panel is symmetrical. Therefore, the driving voltages $+V_1$ and $-V_2$ are selected not to have the same amplitude. This is due to the fact that the crystal condition differs from each other on the front and rear surfaces of the EL layer. That is, the particle size is small and the orientation is not satisfactory during the first period of the evaporation, but the particle size becomes large and the orientation is enhanced when the thickness of the layer becomes long. Therefore, the depth of the surface level and the probability of the electron trap differ from each other on the front and rear surfaces of the EL layer.

The above-mentioned EL-display panel has a size corresponding to an eight inches Braun tube, or, 12 cm × 16 cm. In this embodiment, the rear electrode 5 is made of aluminum. Since the one electrodes are transparent electrodes 2 and the others are metal electrodes 5, the transparent electrodes 2 are preferably positioned on the shorter side, or, the vertical side, in order to reduce the series resistance of the circuitry. Therefore, in this embodiment, the X-line electrodes are made of the transparent electrodes and the Y-line electrodes are made of aluminum. Referring again to FIG. 12, the three phase resonance sustaining drive will be described hereinbelow. In this chart, $$V_H = V_2 \exp(-\alpha\pi/f)$$

$$\beta = \arctan(1/\alpha)$$

In order to facilitate the understanding of the present invention, the coefficient $\eta$ can be considered as a coefficient which shows additional increase of the potential to be applied to the capacitive component C after the half cycle of the LC resonance with respect to the potential difference applied to the LC circuit. The coefficient $\eta$ has already been formulated in the foregoing description.

When the first switch $SW_1$ is closed by the first timing signal $\phi_1$, the capacitive element $C_T$ is connected to receive the voltage difference created by the third hold voltage $V_H$ and the first power supply voltage $E_1$, and the voltage is held at the first hold voltage $V_1$, which is the value determined by the above-mentioned voltage difference and is overrunning $\eta$ times the above-mentioned voltage difference.

$$V_1 = E_1 + \eta(E_1 - V_H) \quad (7)$$

Similarly, the second switch $SW_2$ is closed when the second timing signal $\phi_2$ is developed, and the voltage is held at the second hold voltage $V_2$.

$$-V_2 = -E_2 - \eta(V_1 + E_2) \quad (8)$$

And the third switch $SW_3$ is closed when the third timing signal $\phi_3$ is developed and, therefore, the voltage is held at the third hold voltage $V_H$.

$$V_H = \eta V_2 \quad (9)$$

In this way the three phase drive is accomplished.

The multiphase sustaining drive in more than three phases can minimize high voltage requirement of the data switch elements $DS_1$, $DS_2$, . . . , since the write-in operation can be effected during the third phase or in the third hold voltage $V_H$, which has an intermediate potential level.

2. WRITE-IN DRIVE

The reason why the high voltage requirement of the data switch elements is minimized will be described hereinbelow. The high voltage requirement of the data switch elements DS in the data switch circuit 30 can be minimized by performing the write-in operation during the period of the intermediate potential level $V_H$.

Now assume the condition when the write-in operation is effected on the picture point M (j, i), that is, the point of the j-th row and the i-th column in the matrix panel 50 during a period of time when the intermediate potential hold voltage $V_H$ is applied to the panel. The write-in switch WSi of the i-th column is short-circuited to a write-in voltage $V_w$ (in this test model 270 - 280 volts), and the remaining switches $WS_k$ ($k \neq i$) are kept open. And the j-th row switch $DS_j$ in the data switch circuit 30 is kept closed and the remaining switches $DS_l$ ($l \neq j$) are open. The operation will be described with reference to FIG. 13. In this time chart, the symbols $\Delta V_{Hi}$ and $\Delta V_H$ represent the following values.

$$\Delta V_{Hi} = \frac{(V_W - V_H) + (n-1)(V_W - V_F)}{n}$$

$$\Delta V_H = \frac{V_F}{n}$$

The Y-line receive the following voltage except the j-th line in this write-in operation.

$$V_F = \frac{n-1}{(m-1)+(n-1)}(V_W - V_H) \quad (10)$$

Therefore, the data switches DS are constructed so as to tolerate the above-mentioned voltage $V_F$. The voltage $V_{FH}$ is reduced by provision of the intermediate level $V_H$ as compared with the case when the write-in operation is effected from the ground potential.

$$V_{FH} = \frac{n-1}{(m-1)+(n-1)} V_H \quad (11)$$

In the matrix construction of $m = n >> 1$ ($m$ is the number of lines in the X direction and $n$ is the number of lines in the Y direction, that is, an $m \times n$ matrix pattern), the equation (10) can be modified as follows:

$$V_F = \frac{V_W - V_H}{2}$$

Therefore, the high voltage requirement is minimized by $V_H/2$.

In the foregoing description, the high voltage requirement is compared with the case where the write-in operation is carried out from the ground potential. The write-in operation of the present invention is more effective as compared with the two phase drive, wherein the write-in operation is conducted during a period when the second level $-V_2$ is held and in which the high voltage requirement is $V_W + V_2/2$.

The non-selected points on i-line receive the following half selected level $V_{NSi}$ during the time period when write-in operation is conducted to one picture point.

$$V_{NS_i} = \Delta V_{W_i} = \frac{(V_W - V_H) + (n-1)(V_W - V_F)}{n} \quad (12)$$

The non-selected points on j-line receive the following half selected level $V_{NS_j}$ during the time period when write-in operation is conducted to the picture point M (j, i).

$$V_{NS_j} = V_H + V_F \quad (13)$$

When $m = n >> 1$, the following equation is derived from the equations (10), (12) and (13).

$$V_{NS_i} \approx V_{NS_j} \approx \frac{V_W + V_H}{2} \quad (14)$$

The "half selected" means a condition with either one of the X-line or Y-line of the picture point is selected. The condition which prevents the write-in operation in the half selected but non-selected picture point is expressed as follows:

$$V_{NS_i}, V_{NS_j} < V_1 \quad (15)$$

In the driving circuit of the test model, $V_1 = 215$ volts;
$V_W = 275$ volts;
$V_H \approx 70$ volts;
$m = 260$
$n = 168$ and, therefore, $V_F$, $V_{FH}$, $V_{NS_i}$ and $V_{NS_j}$ can be calculated as follows through the use of the equations (10), (11), (12) and (13).

The high voltage requirement to the switching elements of the Y-line:

$V_F \approx 80$ volts

The reduced value of the high voltage requirement:

$V_{FH} \approx 27$ volts

The half selected level at the non-selected picture point on the i-th scanning line:

$V_{NS_i} \approx 195$ volts

The half selected level at the non-selected picture point on the j-th data line:

$V_{NS_j} \approx 150$ volts

This satisfies the condition (6) and, therefore, the write-in operation can be effected on the selected point. In a simplified example, or, $m = n >> 1$, the equation (14) can be applied. From the equations (14) and (15), the level $V_H$ can be selected within the following range.

$$V_H > 2V_1 - V_W \quad (16)$$

That is, the high voltage requirement of the data switch circuit can be minimized by selecting the intermediate level $V_H$ as high as possible within a range not to effect the write-in operation at the non-selected picture point.

3. HOW TO RENDER INTERMEDIATE LEVEL VARIABLE

It is desired that as described previously the intermediate level is high sufficient not to cause erroneously writing into any half-selected picture points. However, it is much difficult for the EL display panels to always ensure reproducibility of the various operating characteristics thereof (e.g., the capacitance between both electrodes) with accuracy because these EL display panels comprise sequentially deposited thin-films on the glass plates as viewed from FIG. 1. Preferably, the EL display panel driving circuitry is, therefore, constructed to enable adjustment for the intermediate level and then the intermediate level is selected at a desired value in accordance with its associated EL display panels.

The following sets forth how to render the intermediate voltage variable.

Figure 14:
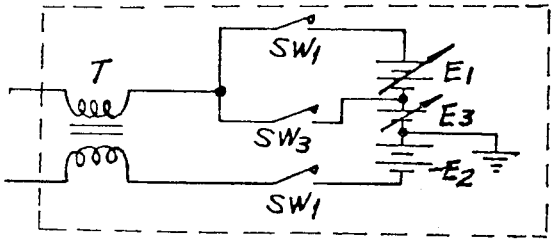
FIG. 14 is a circuit diagram showing a part of yet another embodiment of a drive circuit of the present invention.

The first approach is to connect the one end of the third sustaining switch $SW_3$ within the sustaining circuitry 10 with the third variable power source $E_3'$ (shown in FIG. 14) rather than ground potential. With this arrangement, a new intermediate level $V_H'$ is given as follows:

$$V_H' = (1+\eta)(E_3' + V_2) - V_2 = (1+\eta)E_3' + \eta V_2$$

with varying intermediate level, the first level $V_1$ is of course varied pursuant to the formula (7). The first power source is also made variable to avoid such variations in the first level $V_1$.

The alternative approach is to render a period of time where the third sustaining switch $SW_3$ is closed variable. In other words, the width of the third timing pulse $\phi_3$ of FIG. 12 becomes variable. When the closed period is variable within a range smaller than the half of the natural oscillation period, increase in voltage from the second level-$V_2$ up to the intermediate level $V_H'$ will be correspondingly blocked. As a result, the intermediate level $V_H$ can be arbitrarily established in accordance with changes in the pulse width. Similarly, in this instance the first power source is made variable for the reason discussed above.

4. COMPENSATION FOR HALF-SELECTED LEVEL IN WRITE-IN OPERATION

In the foregoing description, no attention is directed to the compensator 60 for half-selected level in writing. This circuitry 60 is adapted to eliminate errors in writing which occur when a number of data switches (Y lines) are selected simultaneously at one time. The following formula represents the half-selected level $V_{NS}(l, i)$ at the non-selected picture elements M $(l, i)$ (wherein $l \neq j, J+1, \ldots J+N-1$; as designated by circles in FIG. 17 on the first scanning line when one line (that is, i line) is selected within the sequentially scanned lines and N lines (that is, j line through j + N − 1 line) are selected within the data lines (Y lines):

$$V_{NS}(l,i) = V_W - V_F = \frac{N(m-1)}{N(m-1)+(n-N)} V_W + \frac{n-N}{N(m-1)+n-N} V_H \quad (17)$$

wherein $m, n >> N$.

From the relationship $\Delta V_{H_i} + V_H \geqq V_W - V_F$, although $\Delta V_{H_i}$ may be omitted in the half-selected level $V_{NS\,(l,\,i)}$ defined by the above formula (17), the half-selected level is represented as $V_W - V_F$ for convenience sake since a $V_1$ stabilizing circuitry described later serves to render $\Delta V_{Hi}$ zero.

Meantime, the half-selected level $V_{NS}(j, k)$ at the non-selected picture elements M (J, $k$) (wherein $J = j, j+1, \ldots, j+N-1$; as designated by triangles in FIG. (7) on $j$ data line is given as follows:

$$V_{NS}(J,k) = V_H + V_F = \frac{n-N}{N(m-1)+(n-N)} V_W + \frac{N(n-1)}{N(m-1)+(n-N)} V_H \quad (18)$$

wherein $m, n >> N$.

In this stance the formula (18) with respect to the half-selected level is duly justified because of the relationship $\Delta V_H < V_F$.

Figure 17:
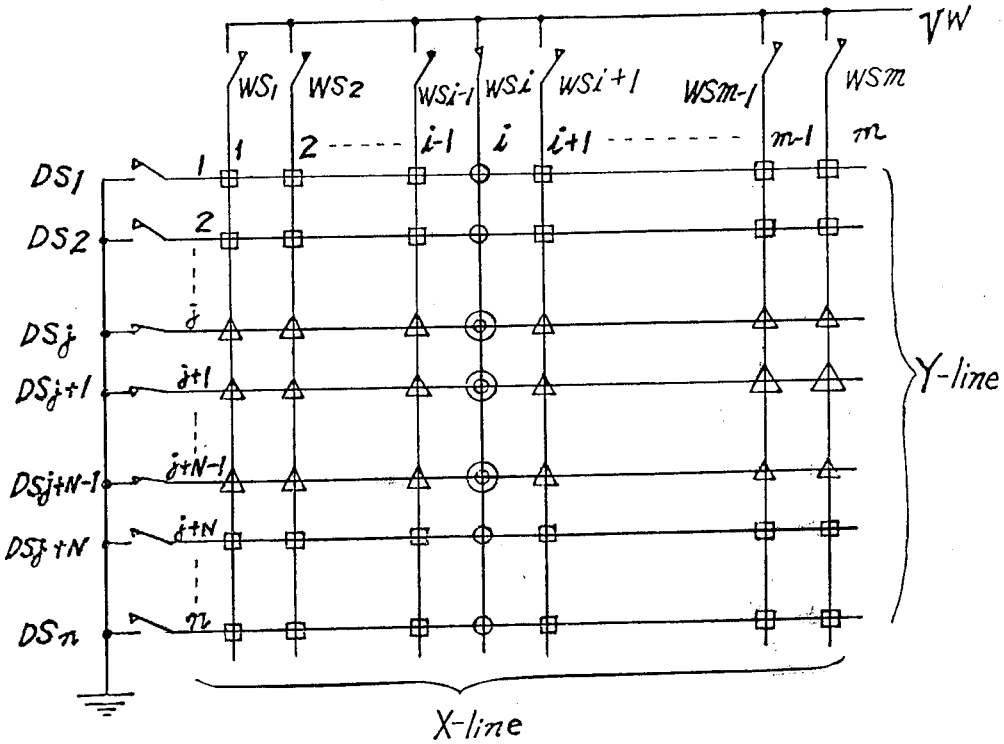
FIG. 17 is a chart showing conditions of each picture point of a memory matrix EL panel.

The non-selected level at the non-selected picture elements M $(l, k)$ $(k \neq i\,;\, l \neq j, j+1, \ldots J+N-1$; designated by squares in FIG. 17) is $\Delta V_H$.

To consider errors in writing in the non-selected picture elements, careful attention should be directed to the half-selected levels $V_{NS}(l, i)$ and $V_{NS}(J, k)$ defined by the formulae (17) and (18). TABLE 1 lists the half-selected levels for the respective values of the number N of the data selection in the embodiment.

TABLE 1

| N | $V_{NS(l,\,i)}$ | $V_{NS(J,\,k)}$ | $V_F$ |
|---|---|---|---|
| 1 | 194 | 150 | 80 |
| 2 | 225 | 120 | 50 |
| 3 | 238 | 106 | 36 |
| 4 | 247 | 98 | 28 |

wherein $m = 260$, $n = 168$, $V_H = 70V$, $V_W = 275V$, $V_1 = 215V$.

Analysis of the above table reveals that writing operation will be taken place on the non-selected picture elements M $(l, i)$ $(l \neq j, j+1, \ldots, J+N-1)$ when $N \geqq 2$ because of the existing relationship $V_{NS}(l, i) > V_1$. The half-selected level compensation circuitry 60 is to prevent such errors in writing operation.

It will be obvious from the formula (17) that decrease in the necessary breakdown voltage $V_F$ produces increase in the non-selected levels at the non-selected picture elements M $(l, i)$, on the first scanning line. Therefore, these errors in writing on the non-selected picture elements M $(l, i)$ are due to the fact that the necessary breakdown voltage $V_F$ declines when the number N of data selection is increased. To this end, the breakdown voltage $V_F$ is required not to decrease to such extent when the number N of data selection is increased. The circuitry 60 achieves the object by connecting all the non-selected lines in the X lines with compensation level $V_{wc}$ from the source $E_c$ via a switch $SW_c$ in the writing mode.

Figure 18:
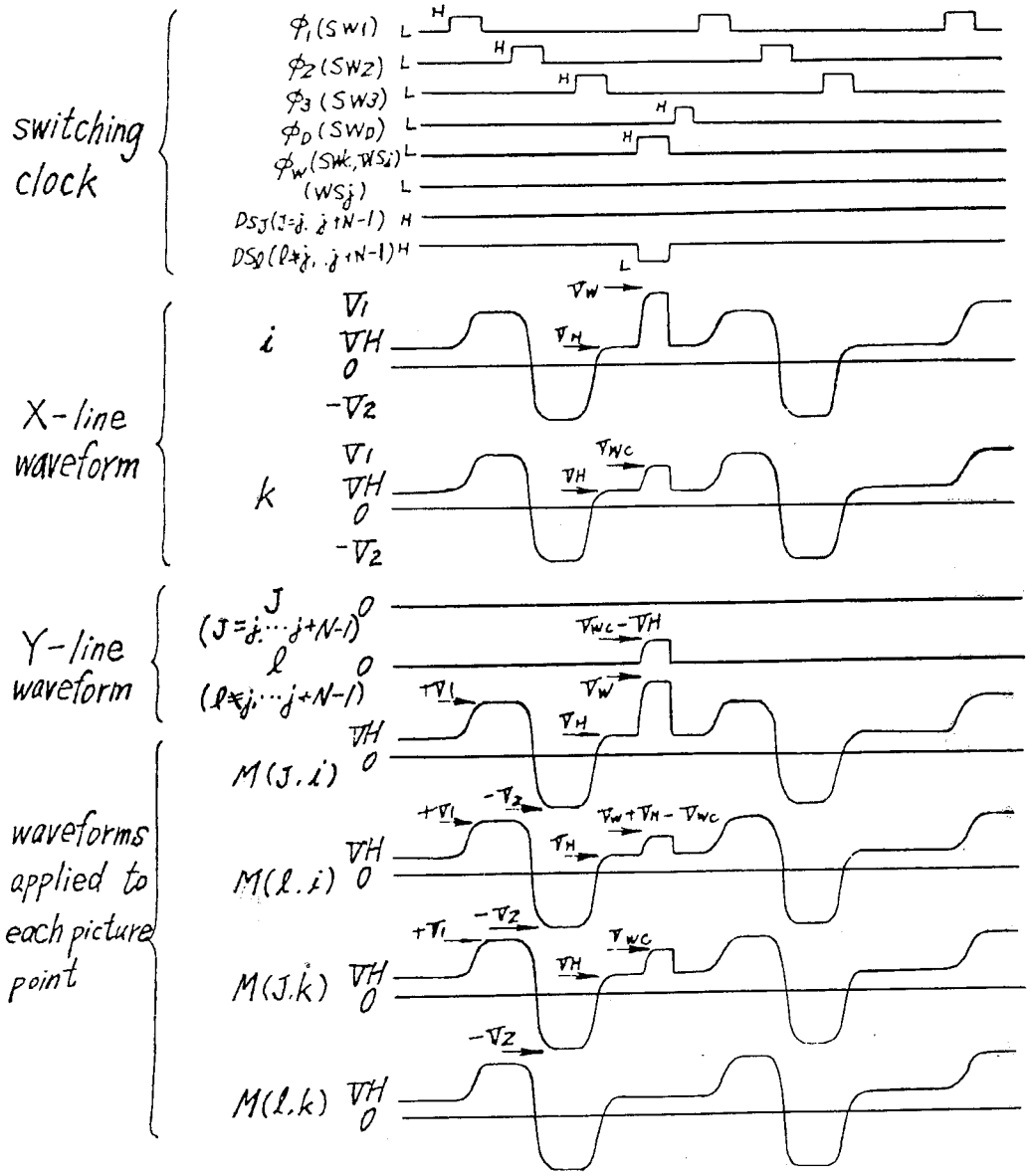
FIG. 18 is a time chart showing operation of the circuit of FIG. 8.

FIG. 18 illustrates waveforms of various signals in the case where the compensation circuitry 60 is added. These waveforms are illustrated when the sustaining level is stabilized as will be described later on.

The following formulas show the half-selected levels $V_{CNS}(l, i)$ and $V_{CNS}(J, k)$ at the non-selected picture elements M $(l, j)$ and M (J, $k$) respectively when the compensation switch $SW_c$ is closed in synchronization with the writing rhythm.

$$V_{CNS}(l, i) = V_W + V_H - V_{WC} \quad (19)$$

$$V_{CNS}(j, k) = V_{WC} \quad (20)$$

Under these circumstances, the compensation level $V_{WC}$ is established to meet the relationship as follows:

$$V_{CNS}(l, i),\ V_{CNS}(j, k) < V_1 \quad (21)$$

For examples, the formulas (19) and (20) are rewritten as follows when $V_{CNS}(l, i) = V_{CNS}(J, k)$:

$$V_{CNS}(l, i) = V_{CNS}(J, k) = \frac{V_W + V_H}{2} \quad (22)$$

The inventors' experiments reveal the facts that the satisfactory results are given under the conditions: $V_W = 275$ V; $V_H = 70$V and $V_1 = 215$V. In this case $$\frac{V_W + V_H}{2} = 173$$

and thus the requirement defined by the formula (21), $$\frac{V_W + V_H}{2} < V_1$$

is completely fulfilled.

Figure 19:
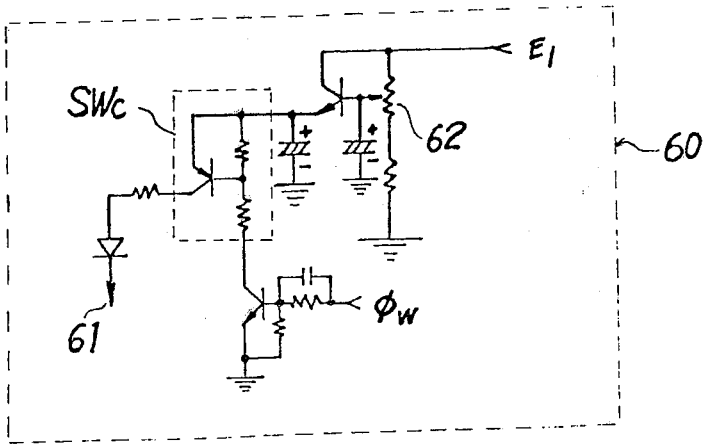
FIG. 19 is a circuit diagram of an embodiment of a compensation circuit for a half selected level in writing operation included with the circuit of FIG. 8.

FIG. 19 is a detailed circuit diagram of the embodiment wherein the half-selected levels are under control of a variable resistor 62. In the given embodiment the first sustaining power source $E_1$ is also utilized as a power source and no particular compensation power source is required.

5. SUSTAINING LEVEL STABILIZER

A sustaining level stabilizer circuitry 70 is means for preventing the amplitude of the sustaining waveform from varying in accordance with variations in voltages of the respective picture elements which occur in the writing mode. In the event that voltage of the respective picture elements is varied (for example, increased to the level higher than $V_H$) in the writing mode without utilizing the stabilizer 70, the first level will be held somewhat lower than $V_1$ as clear from the formula (7) when the first sustaining switch is closed at the first timing.

At the second timing the second level is held at a value smaller than the absolute value of $-V_2$ as clear from the formula (8). The sustaining of the luminescence status or non-luminescence status will be influenced adversely due to these deviations.

Figure 13:
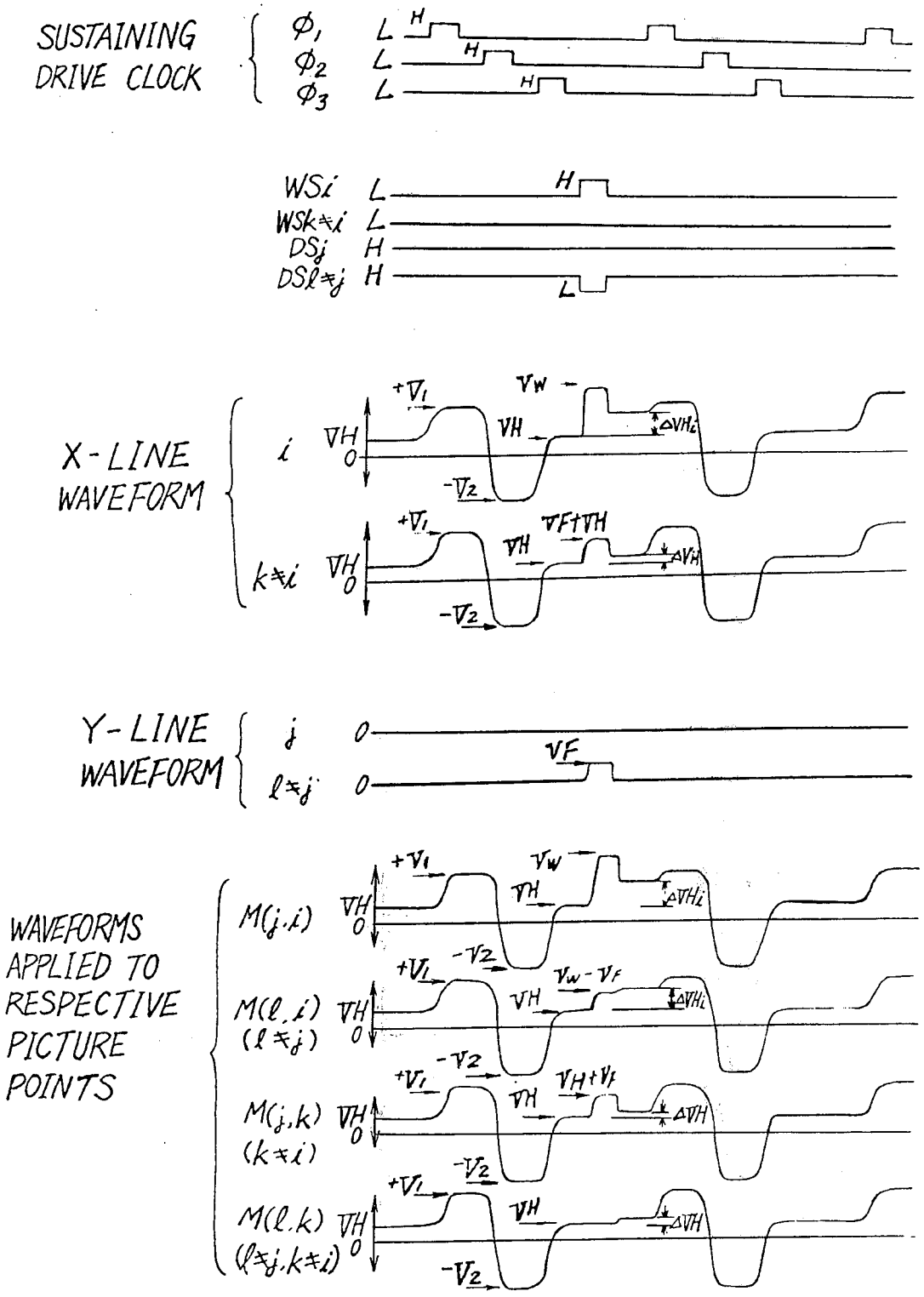
FIG. 13 is a time chart showing a condition when a compensation circuit for a half selected level in writing operation and a sustaining potential stabilizing circuit in the circuit of FIG. 8 are omitted.

The mode of operation in the absence of the stabilizer 70 will be set forth in more detail with reference to FIG. 13 to facilitate understanding of the function of the stabilizer 70.

The inventors' experiments are carried out in the case that the half-selected level compensation circuitry 60 is included. Increase in the intermediate level $V_H$ due to the residual charge is effected as follows. In the writing mode, all the scanning $k$ lines ($k \neq i$) are connected to the half-selected compensation voltage $V_{WC}$ except the scanning $i$ line is connected to the writing voltage $V_W$. Voltage of non-selected lines in the Y direction during the writing mode is increased up to the half-selected compensation voltage $V_{WC}$ since these lines are all closed. The scanning $i$ line carries the residual charge of the following amplitude $\Delta C_i$ in the writing mode.

$$\Delta C_i = C_l \frac{-N(V_W - V_H) + (n - N)\{V_W - (V_{WC} - V_H)\}}{n} \quad (28)$$

wherein $m, n > N$ in a matrix of mxn and $C_l$ is the one-line capacitance.

The residual charge amplitude $\Delta C_k$ on the scanning $k$ lines ($k \neq i$) is given as follows:

$$\Delta C_k = C_l \frac{N(V_{WC} - V_H)}{n} \quad (24)$$

The following is for increase in the intermediate potential $V_H$. $\Delta V_{CHi}$ suggests increase of the intermediate potential on the scanning $i$ line, whereas $\Delta V_{CH}$ suggests the counterpart on the scanning $k$ lines ($k \neq i$).

$$\Delta V_{CHi} = \frac{\Delta C_i}{C_l}$$

$$\Delta V_{CH} = \frac{\Delta C_k}{C_l}$$

The level $V_1$ reached followed by LC resonance oscillation when the first sustaining switch $SW_1$ is defined as follows in the same way as in the case of sustaining without writing.

$$V_1 = E_1 + \eta (E_1 - V_H) \quad (7)$$

The variations $\Delta V_1$ in the first level $+V_1$ are represented by the following formula on the assumption that all the scanning lines (X lines) are increased by $\Delta V_H$.

$$\Delta V_1 = -\eta \Delta V_H \quad (25)$$

Decrease of about 30% appears at the first level $V_1$ if the intermediate level $V_H$ is $\Delta V_H$ increased because of $$\eta = \exp\left(-\alpha \frac{\pi}{f}\right) \div 0.3 - 0.32$$

Although the charge amplitude on the scanning $i$ line differs from that on the scanning $k$ lines ($k \neq i$), all the residual charges can be viewed as being approximately averaged. The average C of these charges is as follows:

$$\Delta C = \frac{\Delta C_i + (m-1)\Delta C_k}{m} \quad (26)$$

Since all the scanning lines are separated via diodes in the separator 40 in practical use, the residual charges on the respective lines stand at the hold status. As a consequence, the averaging of the charges throughout the panel is not possible but the above assumption is made for the purpose of explanation only.

The formulas (23), (24) and (25) in combination with $\Delta V_H = \Delta C / C_l$ derived from the formula (26) are rewritten as follows:

$$\Delta V_H = 1/mn\,[N(V_W - V_H) + (n-N)\{V_W - (V_{WC} - V_H)\} + N(m-1)(V_{WC} - V_H) \quad (27)$$

Analysis of the formulas (27) and (25) shows that $\Delta V_1 = -2V$ when $N = 10$, $V_W = 275$ V, $V_H = 70V$, $V_{WC} = 173V$, $m = 260$, $n = 168$ and $\eta = 0.3$. Therefore, means for stabilizing the sustaining are required.

The stabilizer 70 serves the purposes of copying the intermediate potential to the predetermined intermediate potential after the writing operation. As suggested by the stabilizing timing $\phi_D$ in FIG. 18, a stabilizing switch $SW_D$ is operated at the timing intermediate the writing phase $\phi_W$ and the next succeeding sustaining phase (the first sustaining phase $\phi$, in the given example) so that the intermediate level $V_H$ from the power source $E_D$ is supplied to all the picture elements. Comparison of FIG. 18 with FIG. 13 shows that the applied voltage at the respective picture elements is held at the predetermined intermediate level $V_H$ after the writing mode. Operation of the stabilizing switch $SW_D$ shorts the voltages at all the scanning lines into the intermediate potential $V_H$.

Figure 20:
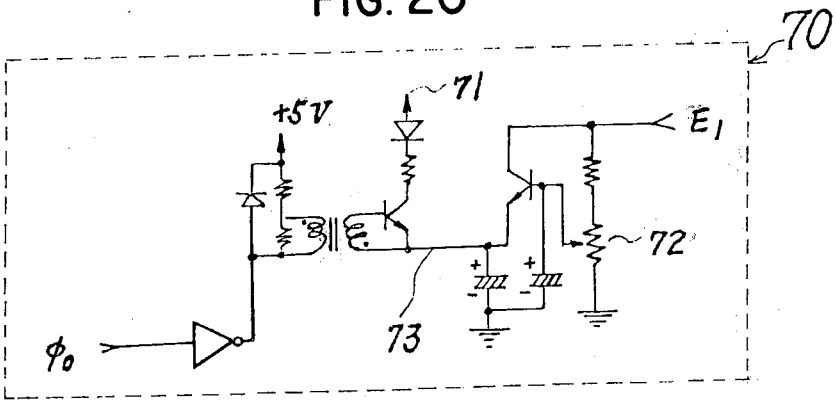
FIG. 20 is a circuit diagram of an embodiment of a sustaining potential stabilizing circuit included within the circuit of FIG. 8.

FIG. 20 shows an example of the stabilizer circuitry set forth above. A terminal 71 is the correspondence to the thermal 71 of FIG. 8. With such arrangement, no particular power source is required because the sustaining power source $E_1$ is utilized as the power source. A terminal 73 is held at the intermediate potential $V_H$ through adjustment of the variable resistor 72. Alternatively, the resistor 72 may be of the fixed resistance type of properly choosing the inherent value thereof. Although in the illustrative embodiment the stabilizer 70 functions to fall the potential since the positive writing voltage is applied when the potential is positive, it may be adapted to raise the potential when the writing is effected via negative voltage.

6. MORE THAN FOUR PHASE SUSTAINING

The concept of the present invention is applicable to not only three phase sustaining but also more then four phase sustaining. This application will be discussed taking an example of four phase sustaining operation.

Figure 15:
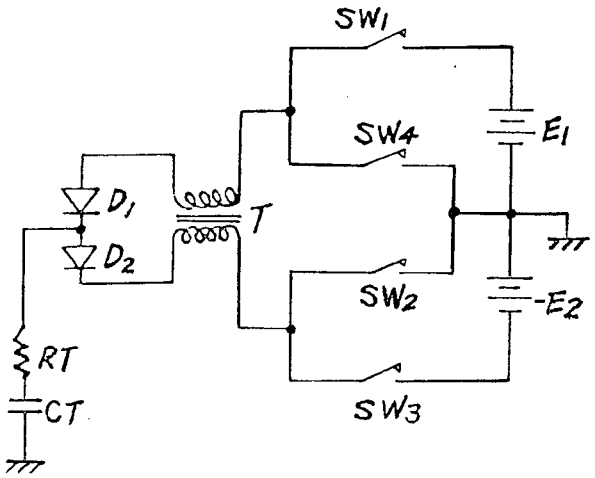
FIG. 15 is a circuit diagram showing a part of a further embodiment of a drive circuit of the present invention.

FIG. 15 is a simplified circuit diagram which corresponds to FIG. 10 of the three phase examples. This includes sequentially-operated sustaining switches $SW_1$, $SW_2$, $SW_3$ and $SW_4$, the first associated with the timing $\phi$, being connected to the first power source $E_1$, the third associated with the timing $\phi_3$ being connected to the second power source $-E_2$ and the second and the last being connected to ground potential.

Figure 16:
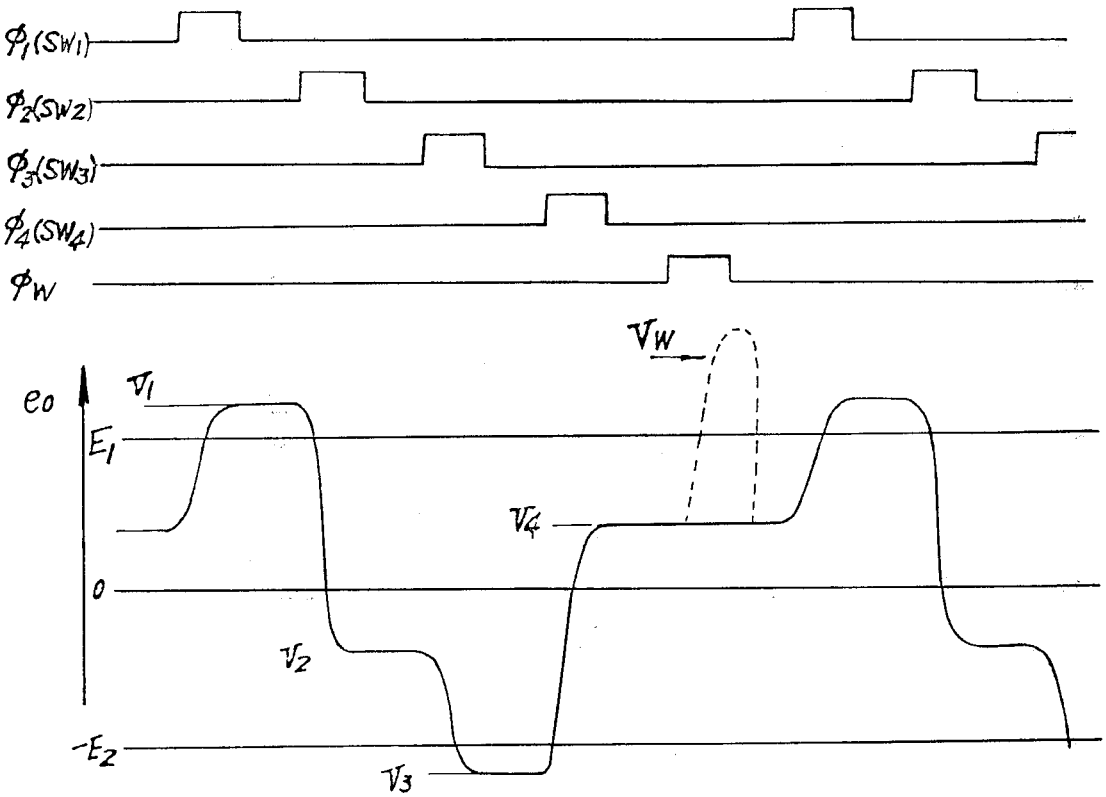
FIG. 16 is a time chart showing operation of the circuit of FIG. 15.

The operation of this circuit arrangement will be described referring to FIG. 16. When the sustaining voltage stands at the fourth level $V_4$, the first sustaining switch is operated and the potential difference is varied as follows:

$$V_1 = E_1 + \eta(E_1 - E_4)$$

The first potential $V_1$ is held. The following variations occur at this time:

$$-V_2 = -\eta V_1$$

$$-V_3 = -E_2 - \eta(E_2 - V_2)$$

$$V_4 = \eta V_3$$

The second and the fourth potentials are at the intermediate level. The writing pulse $\phi_W$ may be applied during either one of these two periods (in the given example, the fourth potential period). Five phase or eight phase sustaining operation becomes possible through the use of different level positive (or negative) power sources.

In the case where the writing operation is carried out with positive voltage during the positive intermediate level period ($V_4$) in this manner, the half-selected level compensation circuitry 60 and the sustaining level stabilizer 70 can be connected in such a manner as shown in the FIG. 8 embodiment. When the write-in operation is carried out with negative voltage during the negative intermediate level period ($-V_2$), the half-selected level compensation circuitry 60 must be connected to the negative power source $-E_2$ and the stabilizer 70 must be connected to the negative positive power source $E_1$. In this case, the respective power sources $E_c$ and $E_D$ are negative ones.

7. SWITCHING CIRCUIT 20 FOR CONTROLLING WRITE-IN OPERATION

The switching circuit 20 controls the opening and closing of the respective switching elements (transistors) through the use of $m$ input terminals (in this embodiment $m$=260) and develops $m$ output signals for write-in operation.

Such a construction requires a plenty of input wires and is not convenient. By the way, the present EL drive circuit is characterized in that only one line in the scanning line or X-line of the EL matrix panel is selected to be switched for write-in purpose at one time, and the plurality of lines are not driven at the same time. Whereas the many data switches may be selected at the same time. For example, when the character "E" is desired to be written-in, the following switches are selected.

The first write-in operation — $WS_1$, $DS_1$, $DS_2$, $DS_3$, $DS_4$, $DS_5$, $DS_6$ and $DS_7$ The second write-in operation — $WS_2$, $DS_1$, $DS_4$ and $DS_7$ The third write-in operation — $WS_3$, $DS_1$, $DS_4$ and $DS_7$ The fourth write-in operation — $WS_4$, $DS_1$ and $DS_7$ The fifth write-in operation — $WS_5$, $DS_1$ and $DS_7$ The required number of the input wires of the switching circuit can be reduced by constucting the selection switches of the write-in control in a matrix structure since only one switch is selected at one time.

Figure 21:
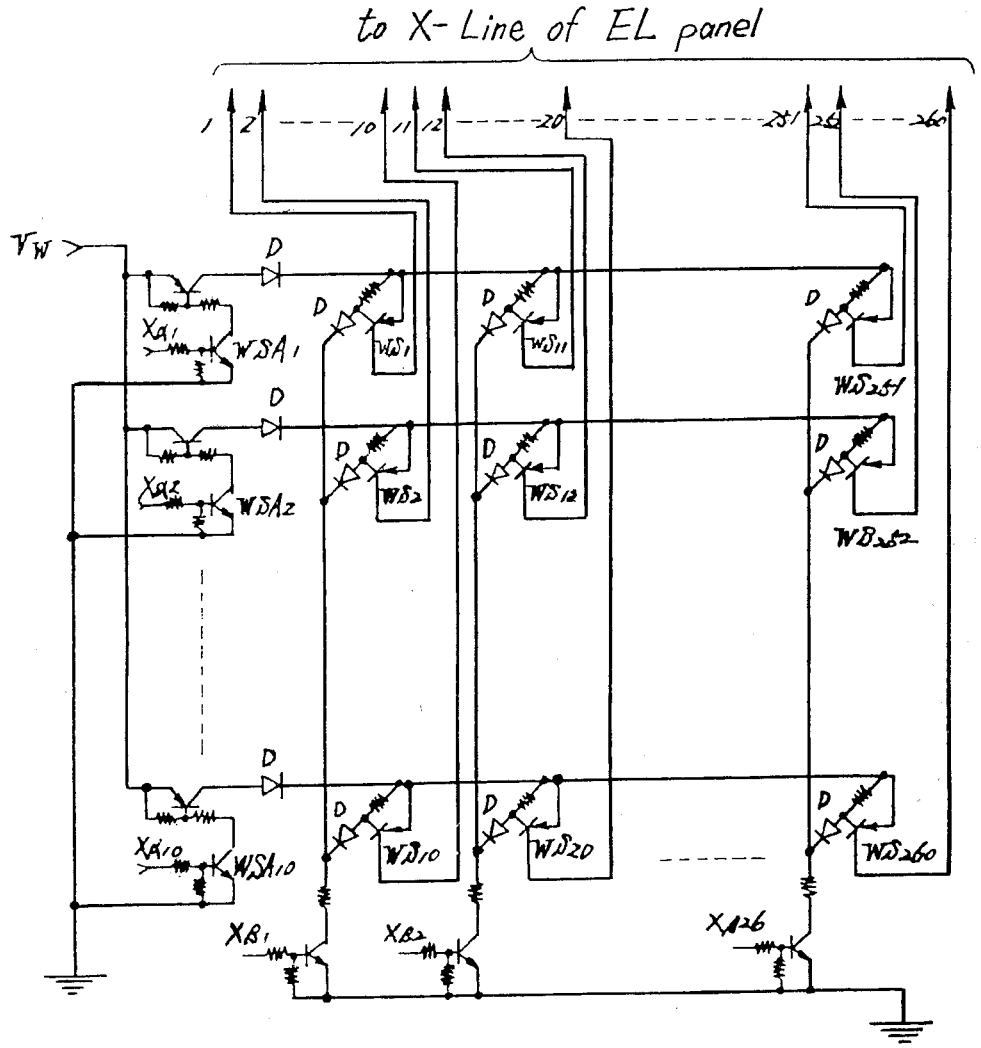
FIG. 21 is a circuit diagram of an embodiment of a write switching circuit included within the circuit of FIG. 8.

FIG. 21 shows an embodiment of the write-in switching circuit 20. In this drawing, D are protective diodes. The circuit selects any one of 260 output wires with the use of 36 input wires, that is, ten wires in $\alpha$ side and twenty-six wires in $\beta$ side.

Transistors $WSA_1$ through $WSA_{10}$ function to amplify input signals since switches $WS_1$ through $WS_{260}$ function to switch a high-voltage write-in voltage $V_W$ (in this example 270 to 280 volts), and they are not responsive to a low level signal. The required numbers of transistors $WSA_1$ through $WSA_{10}$ is considerably reduced to ten although the switches $WS_1$ through $WS_{260}$ are so numerous.

8. RAPID WRITE-IN DRIVE

In the foregoing embodiment, only one vertical line is selected to be written-in during one cycle of the sustaining pulse, or, during the intermediate potential period. Therefore, the write-in speed is determined by the frequency of the alternating sustaining pulse. The frequency of the sustaining pulse can not be so high because of the following reason.

Since the present EL panel has large capacitance (about 0.3 $\mu$F in the eight inches panel), the power loss will occur in the driving because of the displacement current. The power loss is considerably reduced by the LC resonance drive system, but the power loss becomes large as the frequency of the alternating sustaining pulse increases. The uniformity of the brightness at the write-in operation and the erasing operation is unavoidably reduced when the frequency of the sustaining pulse is increased. Moreover, the EL display panel is vibrated by the sustaining pulse. In the foregoing embodiment, the frequency of the alternating sustaining pulse is several hundreds hertz, but the vibration creates obstructive noises when the frequency is increased. Therefore, it is required to determine the write-in speed without regard to the frequency of the sustaining pulse.

Figure 22:
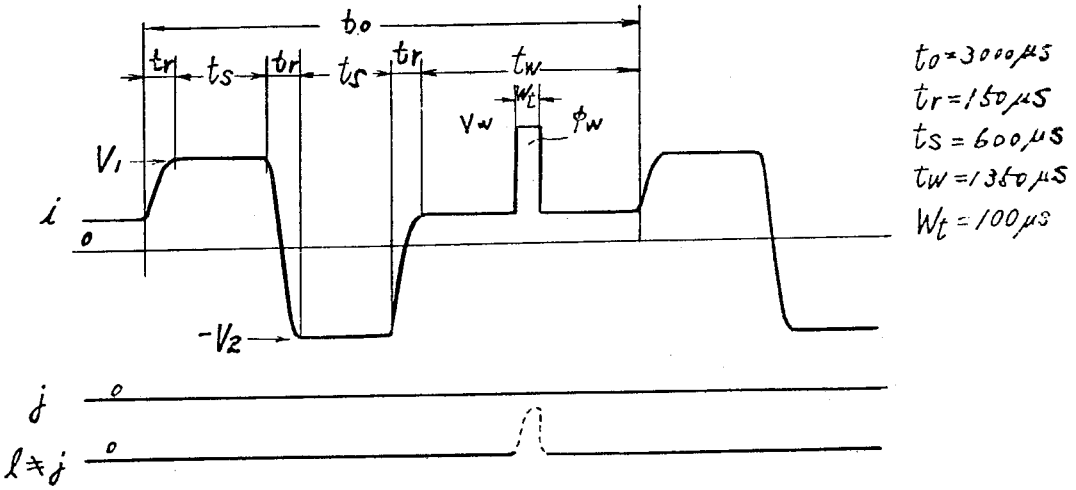
FIG. 22 is a time chart showing operation of usual write drive.
Figure 24:
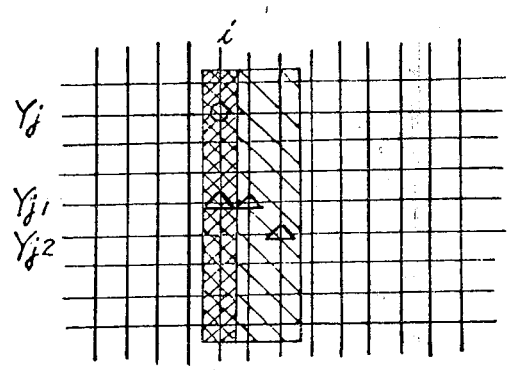
FIG. 24 is a plan view of a memory matrix EL panel showing a written point and an enabled region for writing.
Figure 23:
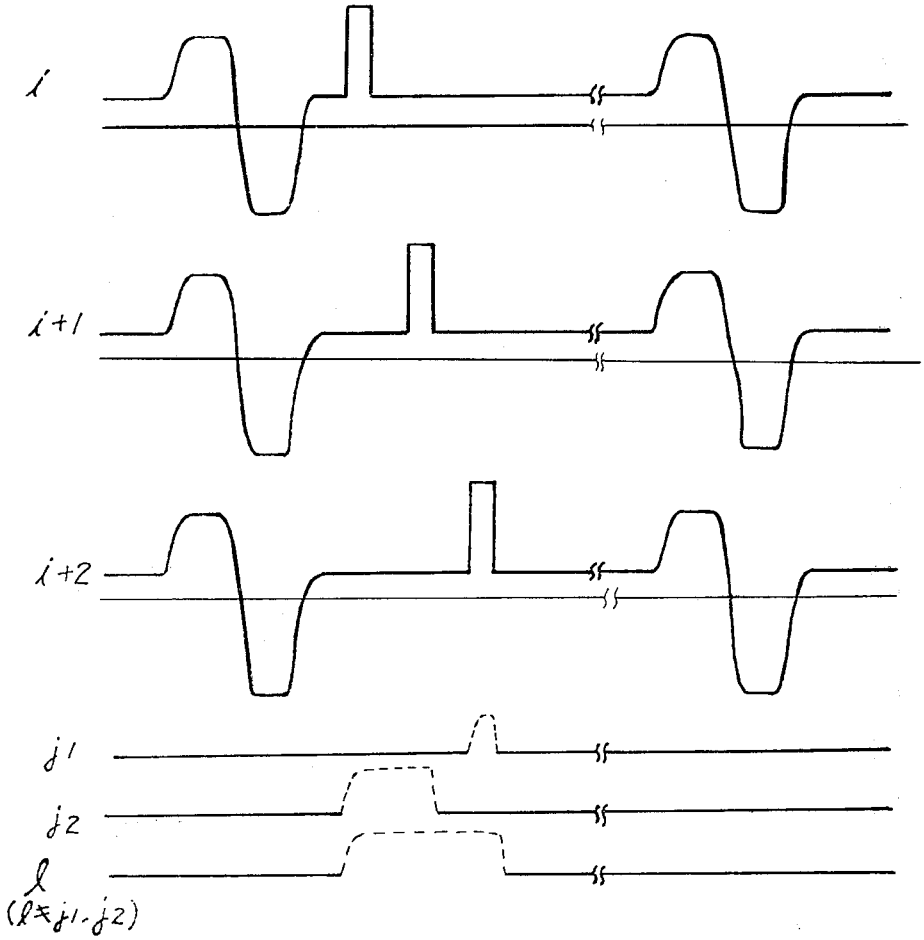
FIG. 23 is a time chart showing operation of rapid write drive.

Referring now to FIGS. 22, 23 and 24, wherein write-in operation is conducted to plural lines during one cycle of a sustaining pulse or during an intermediate potential period.

FIG. 22 shows a j-row waveform and an i-column waveform to conduct the write-in operation onto the picture point ($j$, $i$), that is, the j-th row and i-th column. The write-in phase period (intermediate potential period) tw is selected long in order to enhance the write-in speed. That is, the voltage hold period ts is selected at the same length as the resonance period $t_r$, although FIG. 22 does not exactly illustrate the periods $t_w$ and $t_s$. In principle, the period $t_s$ can be zero since the present EL panel has the hysteresis memory function, but the period $t_s$ is selected to satisfy the condition $t_s = t_r$ by taking the time delay of the light emission into consideration. Therefore, the write-in phase period $t_w$ is expressed as follows:

$$t_w = t_o - 3t_r - 2t_s = t_o - 5t_r$$

The periods $t_r$, $T_s$ and $t_w$ can be easily varied by controlling the interval of the application of the timing pulses $\phi_1$, $\phi_2$ and $\phi_3$.

The resonance period $t_r$ is determined by the capacitance value of the display panel and the inductance value of the resonance coil.

When the frequency of the sustaining pulse is 330 hertz, one period to is 3000 μsec. and the pulse width of the pulses $\phi_1$, $\phi_2$ and $\phi_3$ is 150 μsec. and the write-in phase period $t_3$ is:

$$t_3 = 3000 - 5 \times 150 = 2250 \text{ (μsec.)}$$

When the pulse width $W_t$ of the write-in pulse is selected at 100 μsec. and the spacing between two adjacent write-in pulses is selected at 100 μsec., eleven write-in pulses can be positioned in one cycle. This is because:

$$2250 \div (100 + 100) = 11$$

FIG. 23 shows an example of the write-in operation. In this example, three picture points $(X_i, Y_{j1})$, $(X_{1+1}, Y_{j1})$ and $(X_{i+2}, Y_{j2})$ are written-in in one cycle. The written points are indicated by three triangles in FIG. 24, and the area covered by oblique lines is the write-in enable area. In the embodiment of FIG. 22, the picture point $(X_i, Y_j)$ is written-in (indicated by a circle in FIG. 24), and the area shown by cross-oblique lines is exposed to write-in operation during one cycle period of the sustaining pulse.

9. LINE ERASING CIRCUIT

The line erasing circuit 80 comprises data line separation diodes DE, respective one terminals of which are connected to the connection points of the EL display matrix panel 50 and the data switches $DS_1$, $DS_2$, . . . , and $DS_n$ of the data switch circuit 30, and the other terminals of which are commonly connected with each other and connected to one terminal of an erasing switch SE. The other terminal of the erasing switch SE is connected to an erasing voltage terminal $V_E$ which is connected to a power source $E_E$.

Figure 25:
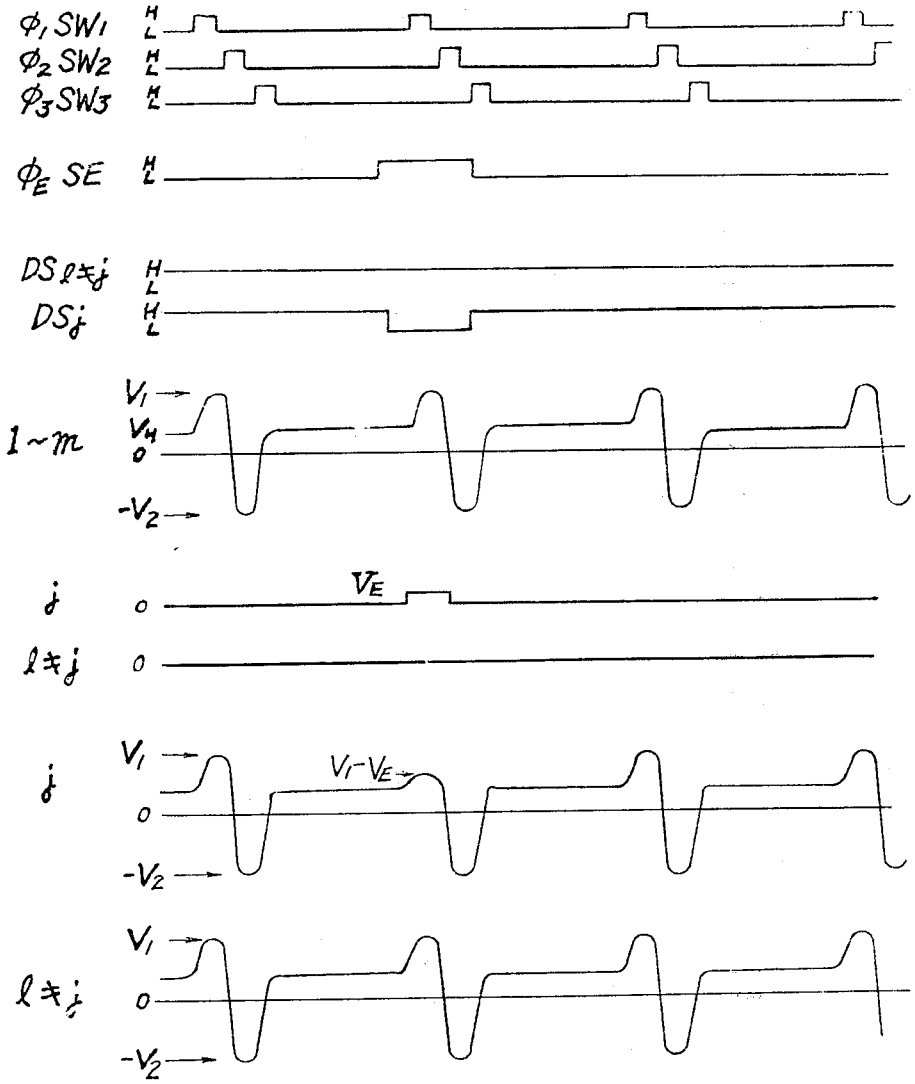
FIG. 25 is a time chart showing line erasing drive operation.

The operation for erasing the data line *j* will be described with reference to FIG. 25. The erasing switch SE is turned on before the time when the switch $SW_1$ is turned on by the clock pulse $\phi_1$, thereby to turn off the data switch $DS_j$ on the line desired to be erased. The data switches $DS_{l \neq j}$ are kept on in order to maintain the sustaining drive. Under these conditions, when the sustaining operation is performed on the scanning lines 1, 2, . . . , and *m* by switching on the switch $SW_1$ by the clock pulse $\phi_1$, the data line *j* is cramped in the erasing voltage $V_e$ since the data line *j* is in the floating condition. That is, the picture points on the data line *j* are connected to receive the erasing voltage, or, the voltage $V_1 - V_E$ when the scanning line 1, 2, . . . , and *m* are supplied with the sustaining voltage $V_1$ through the switch $SW_1$. This erasing voltage corresponds to the voltage $V_3$ in FIG. 2. The data lines $l \neq j$ except the erasing line *j* are supplied with the sustaining voltage $V_1$.

In this way, the erasing voltge is supplied to a desired data line *j*. All the picture points on the data line *j* are erased, and the remaining lines $l \neq j$ are maintained in the previous condition by the sustaining pulse.

The data line to be erased is not limited to one, but the line number for erasing can be selected at a desired number.

The data line *j* is connected to receive the erasing voltage $V_E$, the pulse width of which is identical with one period of the sustaining pulse, and the erasing operation is conducted once. However, it is preferable to supply the erasing pulse four times or five times in order to ensure the erasing. Therefore, in a preferred embodiment, the pulse width of the erasing voltage $V_E$ is selected at five times the pulse width of the sustaining pulse.

Figure 26:
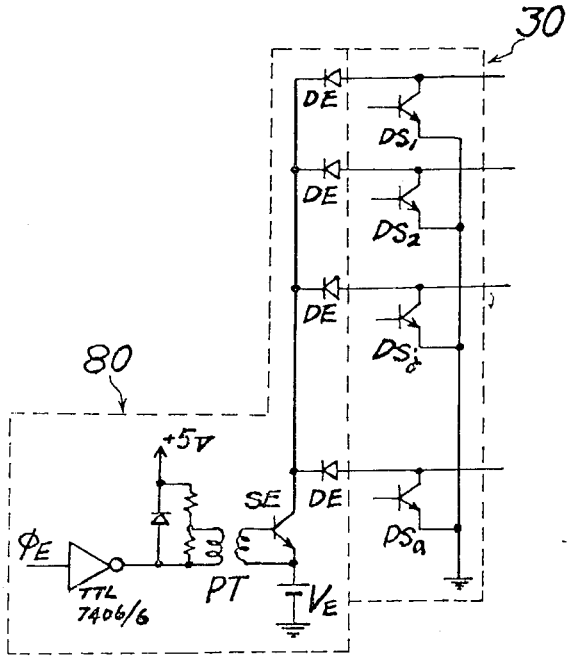
FIG. 26 is a circuit diagram of an embodiment of a line erasing circuit included within the circuit of FIG. 8.

Detailed circuit construction of the data switch circuit 30 and the line erasing circuit 80 is shown in FIG. 26. The data switches $DS_1$ through $DS_n$ are made of transistors, and the erasing switch SE is also made of a transistor. The erasing switch SE is controlled by aphase control pulse $\phi_E$ through an amplifier TTL7406/6 and a pulse transformer PT. The erasing power source $V_E$ is selected at a value corresponding to a voltage difference between the erasing voltage and the sustaining drive voltage, or, in this example, at 25 volts.

10. READ-OUT OPERATION

The read-out operation will be described with reference to FIGS. 8, 27, 28 and 29.

The read-out system mainly comprises the read-out drive circuit 90 and detection resistors R connected to the respective data lines.

Figure 27:
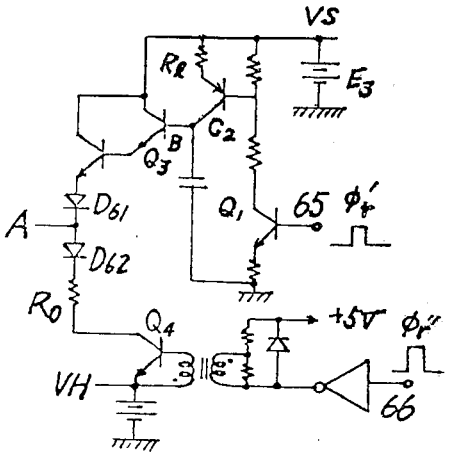
FIG. 27 is a circuit diagram of an embodiment of a read-out drive circuit included within the circuit of FIG. 8.
Figure 29:
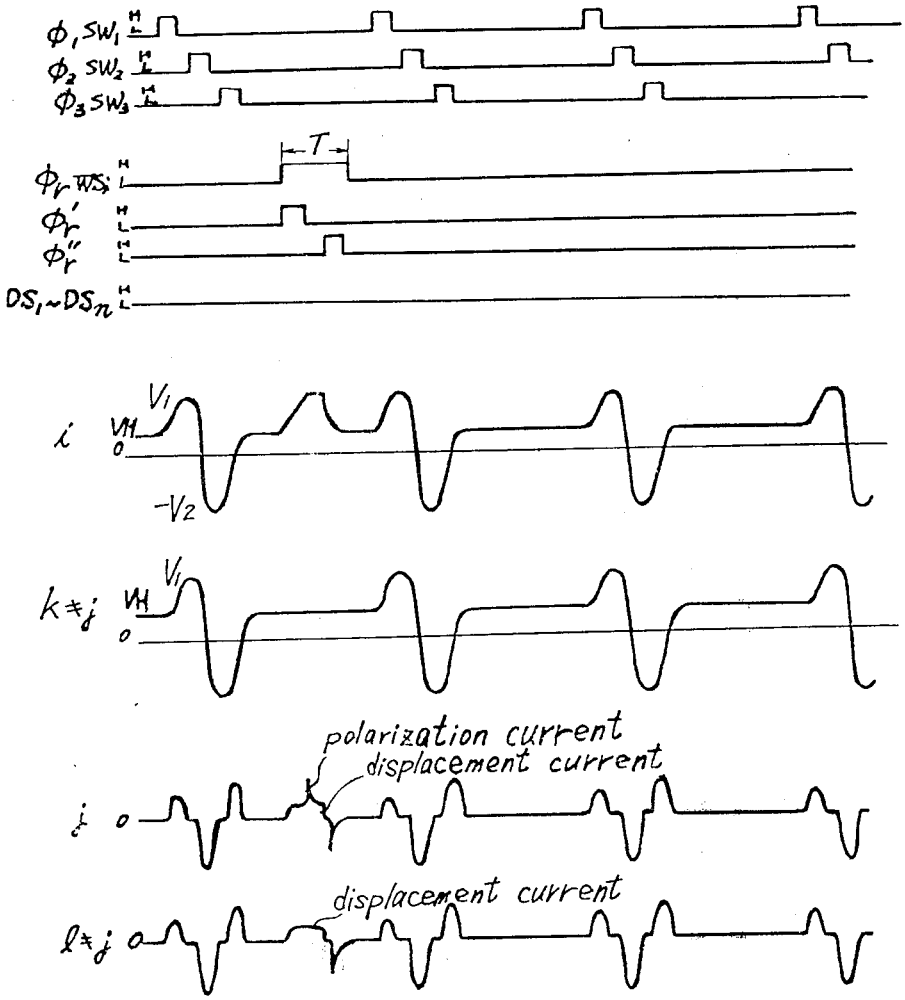
FIG. 29 is a time chart showing read-out drive operation.

Referring now to FIG. 27, in the read-out drive circuit 90, a linear wave generation pulse $\phi_r'$, which takes high level during a first half period of a read-out phase $\phi_r$, is applied to the base terminal 65 of a transistor $Q_1$. Therefore, the transistor $Q_1$ turns on, and a PNP transistor $Q_2$ functions as a constant current source to charge a capacitor $C_r$. A voltage $V_b$ appears at a point B by the constant current *i*.

$$V_b = \frac{i}{C_r} \int_0^t dt + VH$$

where: $C_r$ is a capacitance value of the capacitor $C_r$.

The pulse width of the phase $\phi_r$ is selected at T so that the maximum value of the voltage $V_b$ equals the sustaining voltage $V_1$. That is, $$T > C_r/i \times V_1$$

In this way, the linear waveform appears at the point B. This linear waveform is applied to a line A of the switching circuit 20 via a driving transistor $Q_3$. The transistor $Q_3$ functions to prevent an undesirable influence from the capacitive component of the line to the linear waveform generation. A diode $D_{61}$ functions to protect the transistor $Q_3$ from the write-in voltage $V_W$ applied to the line A.

A hold voltage recovering pulse $\phi_r''$, which takes a high level during a second half period of the read-out phase $\phi_r$ is applied to an input terminal 66 of a transistor $Q_4$. The transistor $Q_4$ turns on during the high level period of the pulse $\phi_r''$ and develops the voltage VH to the line A. This functions to change the voltage level of the line *i* from the read-out voltage $V_1$ to the hold level VH, and to change the potential of the capacitor $C_r$ to hold level VH. A diode $D_{62}$ functions to protect the transistor $Q_4$ when the line A bears a less potential than the hold level VH.

Figure 28:
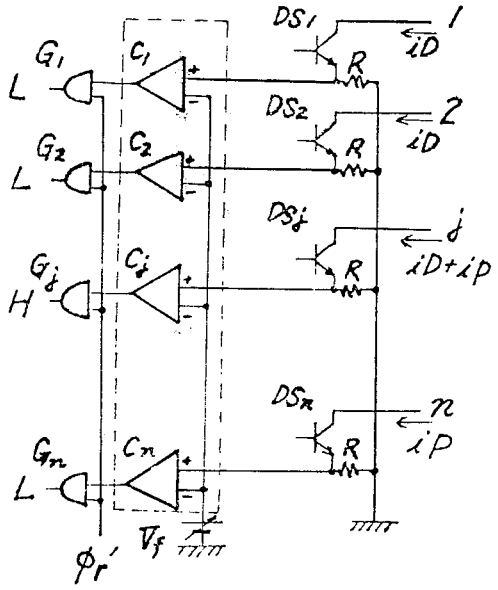
FIG. 28 is a circuit diagram of an embodiment of a read-out detector included within the circuit of FIG. 8.

FIG. 28 shows a detailed construction of the data switch circuit 30.

The data lines *l* through *n* are connected to the collectors of the NPN transistors $DS_1$ through $DS_n$, respectively, the emitters of which are grounded through the detection resistors R. The connection points of the emitters and the resistors R are connected to the positive terminals of comparators $C_1$ through $C_n$, respectively. The negative terminals of the comparators $C_1$ through $C_n$ are connected to a polarization current separation power source $V_f$. The respective output signals of the comparators $C_1$ through $C_n$ are developed through gates $G_1$ through $G_n$, which are controlled to open during the read-out period by the pulse $\phi_r'$.

During the read-out drive period, a read-out mode switch RS is closed, and the line switch $WS_i$ on the scanning line is including a picture point M (*i, j*) to be read-out is closed at the phase $\phi_r$ during the intermediate hold period (VH). At this moment the switches $DS_1$ through $DS_n$ on the data lines *l* to *n* are closed. Upon provision of the pulse $\phi_r'$, the linear waveform signal is applied to the scanning line *i* via the line A and the switch $WS_i$. When the linear waveform signal is applied to the line *i* for read-out purpose, the light emitting conditions of the picture points on the line *i* are not influenced, and a displacement current including a polarization current flows on the data lines 1 through *n* in response to the light emitting conditions of the respective picture points on the data lines 1 through *n*. The light emitting conditions of the respective picture points on the line *i* can be read-out by separating the polarization current from the displacement current.

Now assume the condition where only the picture point M (*i, j*) on the scanning line *i* is in the light emitting condition and the remaining picture points M ($i, l \neq j$) do not emit light. The displacement current id due to the capacitance of the picture point and the polarization current $i_p$ due to the light emission are superimposed and flow on the data line *j*. On the remaining data lines $l \neq j$, only the displacement current $i_d$ flows.

When the linear waveform has a slope of $dV/dt$ and the picture point has a capacitance C, the displacement current $i_d$ can be expressed as follows:

$$i_d = C_l dV/dt$$

The voltage $V_d$ appears across the resistor R.

$$V_d = (i_d + i_p) R$$

The polarization current $i_p$ rapidly flows when the linear waveform voltage exceeds the light emission threshold level, because the driving voltage is superimposed on the internal polarization field formed in the light emitting picture point.

Figure 30A:
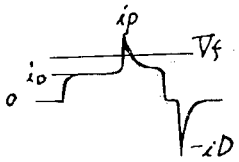
FIGS. 30(a) and 30(b) are graphs showing read-out current waveforms in a written point and a not-written point, respectively.
Figure 30B:
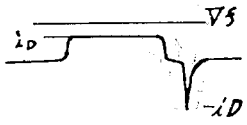

FIG. 30(a) shows a voltage waveform in the case when the polarization current flows, and FIG. 30(b) shows a voltage waveform when the polarization current does not flow.

Since the displacement current id is based on the capacitance of the picture point, the polarization current $i_p$ can be separately detected when the separation voltage $V_f$ higher than the voltage drop (id·R) due to the displacement current $i_d$ is applied to the comparators $C_1$ through $C_n$ as the comparison inputs. The comparator $C_j$ on the write-in data line *j* develops a read-out signal, whereas the remaining comparators $C_{1 \neq j}$ do not develop the output signal. The read-out signal from the comparator is AND gated with the pulse $\phi_r'$ and is shaped. After completion of the read-out operation, the read-out driver 90 supplies the line A of the switching circuit 20 with the intermediate voltage VH, thereby to return the potential applied to the picture point from $V_1$ to the intermediate level VH.

The invention being thus described, it will be obvious that the same may be varied in many ways. Such variations are not to be regarded as a departure from the spirit and scope of the invention, and all such modifications are intended to be included within the scope of the following claims.

What is claimed is:

1. In a drive system for a capacitive display element, which writes desired information in the display element through the use of a write-in signal, maintains the information written in the display element through the use of a sustaining signal, and erases the information written in the display element through the use of an erasing signal, the improvement comprising:

coil means connected to the capacitive display element in a series fashion so that an LC resonance circuit is formed in combination with the capacitive component of the capacitive display element;

circuit means for supplying the capacitive display element with the sustaining signal through said coil means;

said circuit means including a D.C. potential source, diode means and switch means; and said switch means selectively interconnecting said diode means in series with said coil means, said source and said capacitive display elements to selectively reverse the polarity of said source with respect to said capacitive display element in the provision of said sustaining signal.

2. The invention defined in claim 1, wherein said coil means comprises first and second inductors;

said diode means comprises first and second diodes in series respectively with said first and second inductors and in respectively opposed directions of conductivity;

wherein said switch means comprises first and second switching elements respectively and alternatively interconnecting said first diode, said first inductor and said source in series with said capacitive display in one conductive direction and said second diode, said second inductor and said source in series with said capacitive display in the opposite conductive direction.

3. In a drive system for an EL display panel which exhibits hysteresis behavior in its brightness versus applied voltage characteristics, the improvement comprising:

a sustaining signal generation means for maintaining the light emission condition of the EL display panel, the sustaining signal having a maximum potential period, a minimum potential period and an intermediate potential period;

a writing signal generation means for writing a desired information in the EL display panel; and a timing means for placing the writing signal on the intermediate potential period of the sustaining signal.

4. The drive system of claim 3, wherein the EL display panel is a matrix memory EL display panel.

5. The drive system of claim 4, which further comprises a compensation circuit for compensating the sustaining signal level in order to prevent erroneous writing operation.

6. The drive system of claim 4, wherein a plurality of writing signals are placed on an intermediate potential period of the sustaining signal.

7. In a drive system for a memory matrix EL display panel which comprises scanning electrodes formed on a surface of the matrix panel and data electrodes formed on the other surface of the matrix panel, wherein sustaining pulse signals are applied to the matrix panel through the use of the scanning electrodes and the data electrodes in order to maintain the information stored in the matrix panel, the improvement comprising:

means for applying the sustaining pulse signal to the scanning electrodes during an erasing operation period; means for applying an erasing voltage signal to a desired one of the data electrodes during the erasing operation period; and means for applying the sustaining pulse signal to the data electrodes except the selected one for erasing during the erasing operation period.

8. The drive system of claim 7, wherein the erasing voltage signal has an amplitude suited for erasing the information stored in the matrix panel when superimposed on the sustaining pulse signal applied to the scanning electrodes.

9. In a drive system for a memory matrix EL display panel which comprises scanning electrodes formed on a surface of the matrix panel and data electrodes formed on the other surface of the matrix panel, wherein sustaining pulse signals are applied to the matrix panel through the use of the scanning electrodes and the data electrodes in order to maintain the information stored in the matrix panel, the improvement comprising:

means for applying a read-out pulse signal to the scanning electrodes;

detection resistors connected to the respective data electrodes; and means for detecting a voltage drop across the detection resistors for the read-out purpose.

10. The drive system of claim 9, which further comprises means for separating the voltage drop into a component due to a displacement current and another component due to a polarization current.

11. The drive system of claim 10, wherein the separation means comprises a comparator one terminal of which is connected to receive a voltage signal having an amplitude identical with the amplitude due to the displacement current.

* * * * *

UNITED STATES PATENT AND TRADEMARK OFFICE

CERTIFICATE OF CORRECTION

PATENT NO. : 4,070,663

DATED : January 24, 1978

INVENTOR(S) : Yoshiharu KANATANI et al

It is certified that error appears in the above–identified patent and that said Letters Patent are hereby corrected as shown below:

IN THE HEADING OF THE PATENT:

Under "[30] Foreign Application Priority Data"

insert the following:

--Aug. 26, 1975 Japan.....50-103781

June 15, 1976 Japan.....51-70850

June 15, 1976 Japan.....51-70851--

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*